US007950168B2

(12) United States Patent
Nakano

(10) Patent No.: US 7,950,168 B2
(45) **Date of Patent: *May 31, 2011**

(54) ADJUSTABLE FOOTWEAR SOLE CONSTRUCTION

(75) Inventor: Kiyotaka Nakano, Rockford, MI (US)

(73) Assignee: Wolverine World Wide, Inc., Rockford, MI (US)

( * ) Notice: Subject to any disclaimer, the term of this patent is extended or adjusted under 35 U.S.C. 154(b) by 600 days.

This patent is subject to a terminal disclaimer.

(21) Appl. No.: 12/022,369

(22) Filed: Jan. 30, 2008

(65) Prior Publication Data

US 2008/0289219 A1 Nov. 27, 2008

Related U.S. Application Data

(63) Continuation-in-part of application No. 11/855,622, filed on Sep. 14, 2007.

(60) Provisional application No. 60/939,383, filed on May 22, 2007.

(51) Int. Cl.
*A43B 13/18* (2006.01)

(52) U.S. Cl. ..... 36/28; 36/30 R; 36/34 R; 36/37

(58) Field of Classification Search ..... 36/28, 30 R, 36/34 R, 37, 25 R, 100, 39, 27, 29
See application file for complete search history.

(56) References Cited

U.S. PATENT DOCUMENTS

| | | | | |
|---|---|---|---|---|
| 3,377,723 | A | 4/1968 | England | |
| 5,086,574 | A * | 2/1992 | Bacchiocchi | 36/35 R |
| 5,174,049 | A | 12/1992 | Flemming | |
| 5,918,384 | A | 7/1999 | Meschan | |
| 6,205,684 | B1 * | 3/2001 | Snyder | 36/35 R |
| 6,807,753 | B2 * | 10/2004 | Steszyn et al. | 36/28 |
| 6,966,130 | B2 | 11/2005 | Meschan | |
| 6,983,553 | B2 * | 1/2006 | Lussier et al. | 36/28 |
| 7,730,635 | B2 * | 6/2010 | Aveni et al. | 36/27 |
| 7,757,410 | B2 * | 7/2010 | Aveni et al. | 36/28 |
| 2006/0130365 | A1 * | 6/2006 | Sokolowski et al. | 36/35 R |
| 2006/0283046 | A1 * | 12/2006 | Mason | 36/28 |
| 2008/0016718 | A1 * | 1/2008 | Aveni et al. | 36/28 |
| 2010/0192407 | A1 * | 8/2010 | Aveni et al. | 36/28 |

FOREIGN PATENT DOCUMENTS

| | | |
|---|---|---|
| EP | 1733636 | 12/2006 |
| WO | 90/00866 | 2/1990 |
| WO | 2005/053451 | 6/2005 |
| WO | 2006/057978 | 6/2006 |

* cited by examiner

*Primary Examiner* — Ted Kavanaugh
(74) *Attorney, Agent, or Firm* — Warner Norcross & Judd LLP

(57) ABSTRACT

A sole construction includes a cushion insert that is installable in the sole at different orientations to vary the support/cushioning characteristics of the sole. The sole construction may include a midsole defining a receptacle configured to receive the cushion insert in different orientations. The sole may be inserted into low-profile footwear having an outsole with a receptacle for retaining a corresponding differentiated heel portion of the sole. The sole may be included in a shoe construction having an outsole portion capable of bending or pivoting to provide access to the cushion insert for adjustment thereof. The sole may be included in a shoe construction having an outsole that defines an opening, through which the cushion insert may be accessed and manipulated. The cushion insert may include at least one channel that varies in depth about the insert so that different regions of the insert provide different support/cushioning characteristics.

22 Claims, 29 Drawing Sheets

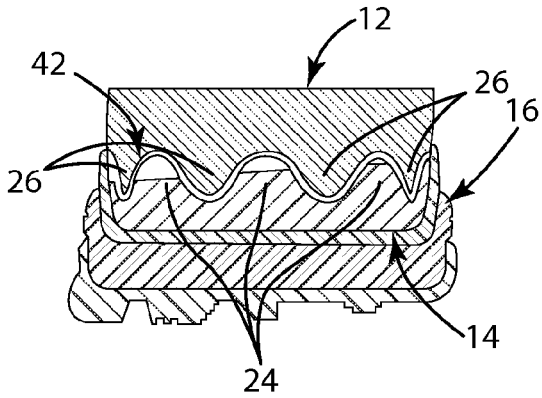
Fig. 4C
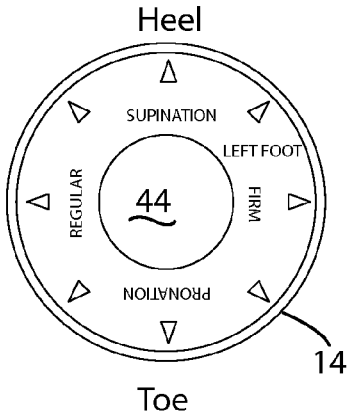
Fig. 9B
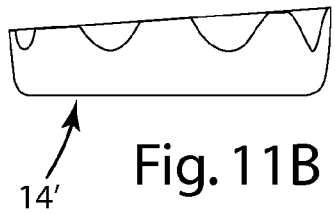
Fig. 11B
Fig. 11A
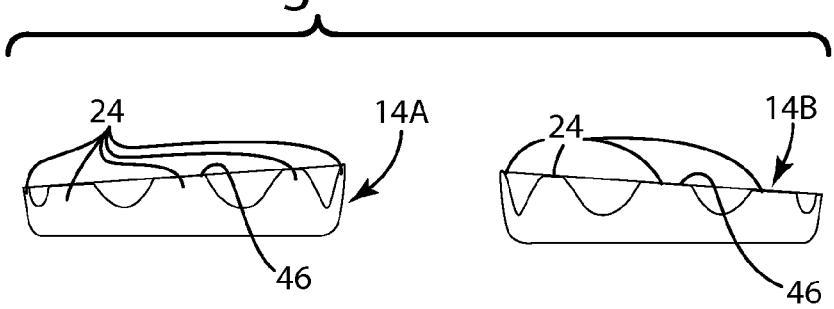

Fig.38
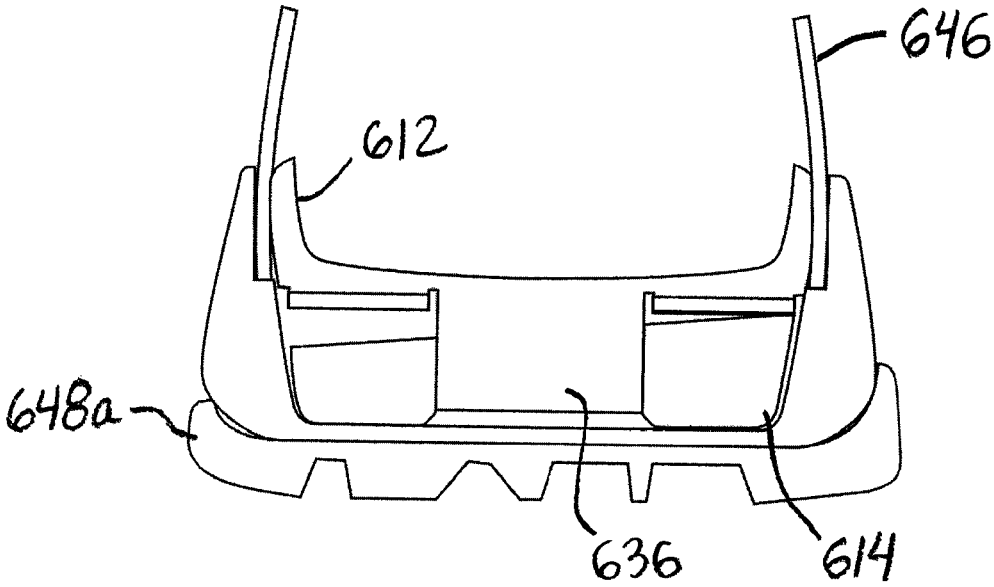
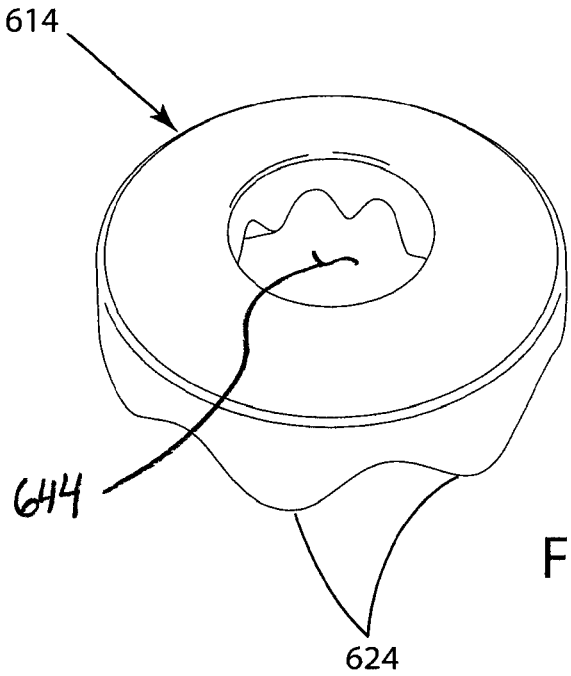
Fig. 39

ADJUSTABLE FOOTWEAR SOLE CONSTRUCTION

CROSS-REFERENCE TO RELATED APPLICATIONS

This application claims the benefit of priority under 35 U.S.C. 119(e) of U.S. Provisional Patent Application No. 60/939,383, filed May 22, 2007, and U.S. patent application Ser. No. 11/855,622, filed Sep. 14, 2007, which are incorporated herein by reference in their entirety.

BACKGROUND OF THE INVENTION

The present invention relates to footwear soles and more particularly to adjustable footwear sole constructions.

The design and manufacture of footwear is complicated by the fact that different people have different footwear needs. For example, some individuals prefer a firmer, more unyielding sole while others prefer a softer, more cushioning sole. With some people this is simply an aesthetic desire, but for others it can result from physical factors, such as those associated with foot shape, skeletal alignment and other anatomical issues. Anatomical issues cause some individuals to suffer from a tendency to pronate (roll their feet inward when striding) and others to have the opposite tendency to supinate (roll their feet outward when striding). One method for addressing these issues is to stiffen the sole in select regions to provide increased resistance against the undesired motion. For example, pronation can be addressed by providing a dual-density midsole with a higher density region along the medial side of the sole. Similarly, supination can be addressed by providing a dual-density midsole with a higher density region along the lateral side of the sole In an effort to address the needs of different consumers, a variety of footwear products have been developed with a customizable sole construction. For example, in one conventional product, the sole defines a void adapted to receive one of a variety of different cushioning inserts. With this product, the wearer is provided with different cushioning inserts that meet different cushioning/support needs. The wearer customizes the sole by inserting the appropriate cushioning insert into the void. The insert may be replaced with alternative inserts in the future as desired to alter the characteristics of the sole. Though providing some degree of customization, this solution requires the manufacture and supply of a plurality of inserts. This can increase cost of manufacture and assembly. Further, the consumer is required to save and store the various inserts to permit future adjustment. Additionally, the number of adjustment settings is a function of the number of inserts supplied with the shoe, which has led to relatively limited adjustability in sole constructions of this type.

SUMMARY OF THE INVENTION

The present invention provides a sole with an adjustable cushion insert that can be positioned in the sole in different orientations to provide the sole with different support/cushioning characteristics. In one embodiment, the sole includes a receptacle adapted to receive the cushion insert. In this embodiment, at least one of the receptacle and the cushion is configured so that positioning of the insert in the receptacle at different orientations varies the support/cushioning characteristics of the sole.

In one embodiment, the adjustable cushion insert is generally disk-shaped. In this embodiment, the cushion insert may be coaxially installed within a complementary disk-shaped receptacle. The mating surfaces of the cushion insert and the receptacle may include a plurality of projections such as lobes, contours, ridges and undulations that are interfitted when the cushion insert is installed in the receptacle. The lobes may be a series of waves undulating through regular angular sections. One or more of the lobes may be truncated or otherwise varied to provide differentiation in the support/cushioning characteristics of the sole. In one embodiment, the lobes are truncated along an angled plane.

The cushion insert may be selectively installed in the receptacle at different angular orientations to provide different cushioning or support characteristics. In the disk embodiment, the characteristics of the lobes may vary around the extent of the cushion insert such that changing the angular orientation varies the support/cushioning characteristics of the sole construction.

In one embodiment, the cushion insert may define a central through-hole or bore configured to fit over a corresponding post in the midsole. The cushioning insert may be rotatably fitted over the post. As a result, the sole construction may be adjusted simply by rotating the cushion insert about the post.

In one embodiment, the cushion insert is adjustable at least between four positions, including "supination," "pronation," "firm" and "regular" settings. In a disk embodiment, the consumer has the ability to rotate the cushion insert to adjust the sole construction to provide regular or firm cushioning, or to address supination or pronation.

In one embodiment, the sole is adapted to be inserted into a loafer or other type of low-profile footwear having an outsole with a corresponding receptacle to retain the sole at the outsole. In this embodiment, the sole may include a differentiated heel portion configured to fit down into a receptacle in the heel of the outsole. The cushion insert may be removably and adjustably mounted to the heel portion at a location where it is contained within the receptacle.

In another embodiment, the sole is included in a shoe construction having an outsole adapted to receive the sole. In this embodiment, a portion of the outsole is adapted to be bent, pivoted or otherwise selectively moved to provide access to the cushion insert, such that the cushion insert may be removed and replaced in a different configuration to vary the support characteristics. In one embodiment, the heel region of the outsole is adapted to bend down and away from the shoe to expose the cushion insert for adjustment.

In yet another embodiment, the cushion insert defines at least one channel, the depth of which varies about the cushion insert to provide different cushioning properties in different regions of the insert. The cushion insert may be removably fitted into the sole at a variety of different orientations to provide different support/cushioning characteristics.

In another embodiment, the sole is incorporated into a shoe construction having an outsole adapted to receive and support the sole. The outsole defines an opening, through which the cushion insert may be accessed and manipulated to vary the orientation of the insert to provide different support/cushioning characteristics. In this embodiment, the outsole may include a sidewall defining openings that provide access to the cushion insert. The cushion insert may be provided with contours that facilitate adjustment of the cushion insert while it remains in place within the sole.

The present invention provides a simple and effective construction that allows a sole to be easily adapted to match the needs of different wearers. In those embodiments that include a disk-shaped cushion insert, the sole can be adjusted simply by rotating the cushion insert within the receptacle. For example, simple rotation of the cushioning insert can permit the sole to be adjusted between regular or firm support, or to address pronation or supination. Because the sole may be adjusted by varying the orientation of a single cushion insert, it is not necessary to supply a wearer with a collection of different inserts that may increase cost and could become lost or misplaced. Further, the wearer is not required to save and store unused adjustable inserts to allow for possible future adjustments. A pair of shoes incorporating cushioning inserts with 8 different orientations in each shoe provides the wearer with 64 different adjustment combinations. An embodiment with a differentiated heel facilitates use of the invention in loafers and other low profile footwear because it permits the cushion insert to be contained within space often occupied by the outsole. Adjustment of the cushion insert may be facilitated in those embodiments in which the cushion insert is accessible through manipulation (e.g. bending or pivoting) of the outsole. In those embodiments in which variation in the cushion insert is achieved through variable depth channels, the upper surface of the cushion insert may remain planar. This can provide the cushion insert with infinite adjustability because, unlike embodiments that incorporate undulations in the cushion insert, it is not desirable to align contours in the cushion insert and the mating sole component. Further, the use of a planar mating surface on the cushion insert may ease manufacture of the interfacing sole components and make the cushion insert more universal. Additionally, in those embodiments in which the cushion insert is accessible through openings in the surrounding sole component(s) (e.g. outsole), adjustment of the cushion insert may be simplified as the cushion insert can be adjusted while the article of footwear is on the wearer's foot and without manipulating any portion of the outsole or other sole components.

These and other objects, advantages, and features of the invention will be readily understood and appreciated by reference to the detailed description of the current embodiment and the drawings.

BRIEF DESCRIPTION OF THE DRAWINGS

FIG. 4*c* is a partially sectional view of the rear of the sole construction.

FIG. 9*b* is a bottom plan view of the cushion insert.

FIG. 11*a* is a front view showing left and right cushion inserts adjacent to one another.

FIG. 11*b* is a front view of an alternative left cushion insert of greater thickness than the left cushion insert of FIG. 11*a*.

FIG. 29*a* shows the insert in the pronation position and FIG. 29*b* shows the insert in the firm position.

FIG. 30*a* shows the insert in the supination position and FIG. 30*b* shows the insert in the regular position.

FIG. 38 is a sectional rear view of the fourth alternative embodiment taken along the lines X-X.

FIG. 39 is a bottom perspective view of the cushion insert.

DESCRIPTION OF THE CURRENT EMBODIMENT

Figure 1:
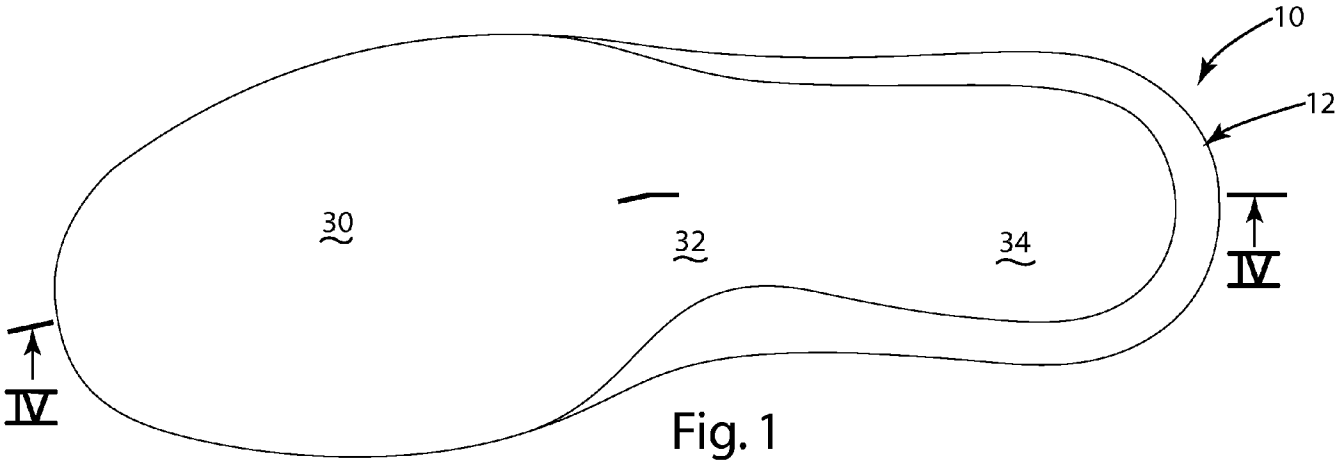
FIG. 1 is a top plan view of a sole construction in accordance with an embodiment of the present invention.

A sole construction in accordance with an embodiment of the present invention is shown in FIGS. 1-11 and generally designated 10. The illustrated embodiment generally includes a midsole 12, a cushion insert 14 and a heel wedge 16. The midsole 12 defines a receptacle 18 adapted to receive the cushion insert 14. The heel wedge 16 is positioned below the midsole 12/cushion insert 14 combination. The top surface 20 of the cushion insert 14 includes a plurality of lobes 24 and the bottom surface 22 of the receptacle 18 includes a plurality of lobes 26. The lobes 24 and 26 may be of different shapes so that they provide different support/cushioning characteristics. The lobes 24 and 26 are interfitted when the cushion insert 14 is installed in the receptacle 18. The components may be seated within essentially any article of footwear. For purposes of disclosure, the present invention is described in connection with a midsole construction. The present invention may, however, be integrated into other sole components, such as an outsole, an insole or a heel wedge. In a midsole construction, the sole construction 10 is typically disposed above or seated within a void in the outsole (not shown). Further, the present invention is described in connection with a cushion insert positioned in the heel region. A cushion insert may alternatively or additionally be positioned in other regions of the sole, such as under the forefoot or other locations where the type of adjustability provided by this construction may be desirable.

The present invention is described in connection with a set of illustrations that include dimensions, notes and other annotations. The dimensions, notes and other annotations contained on the illustrations are exemplary and should not be interpreted to limit the scope of the present invention.

Figure 28:
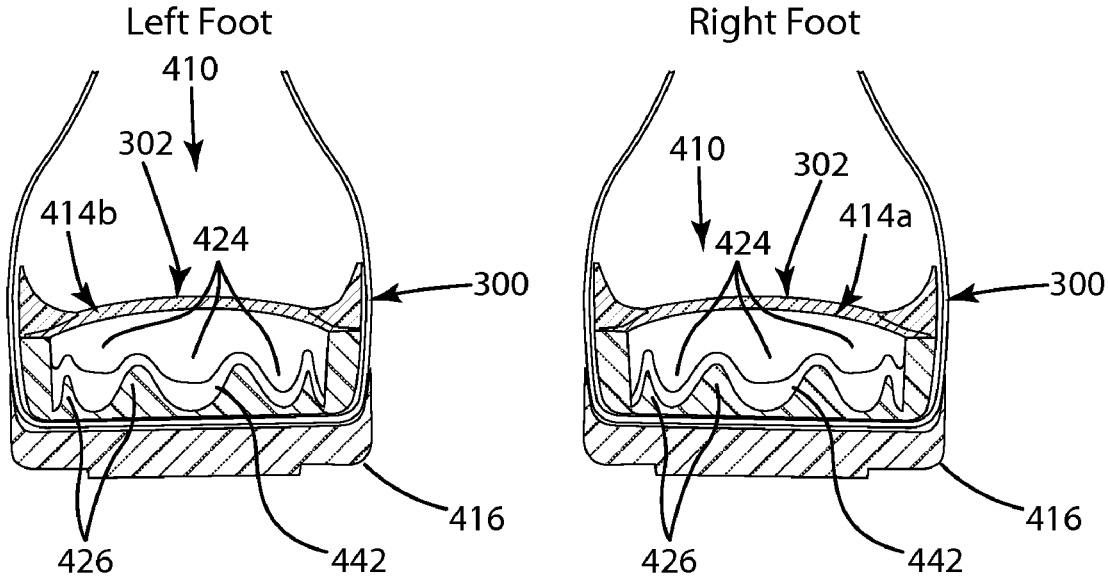
FIG. 28 is a sectional view showing left and right sole constructions adjacent to one another.
Figure 29A:
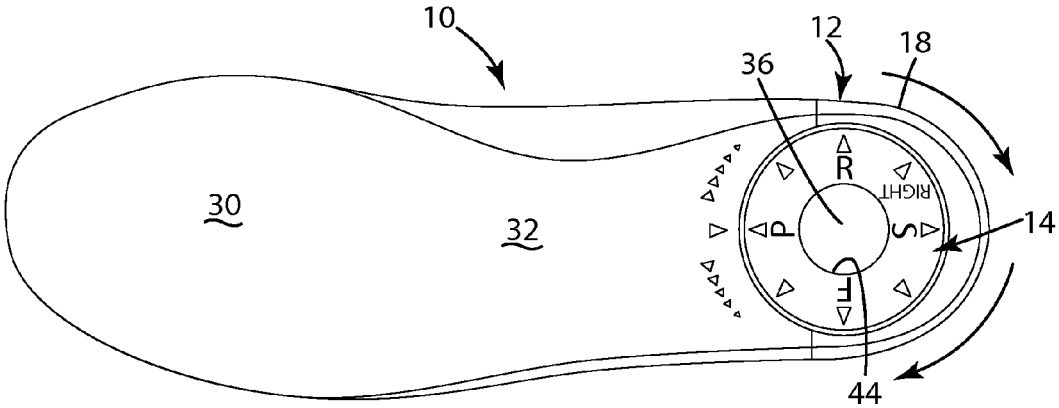
FIG. 29*a-b* are bottom plan views of the sole construction.
Figure 29B:
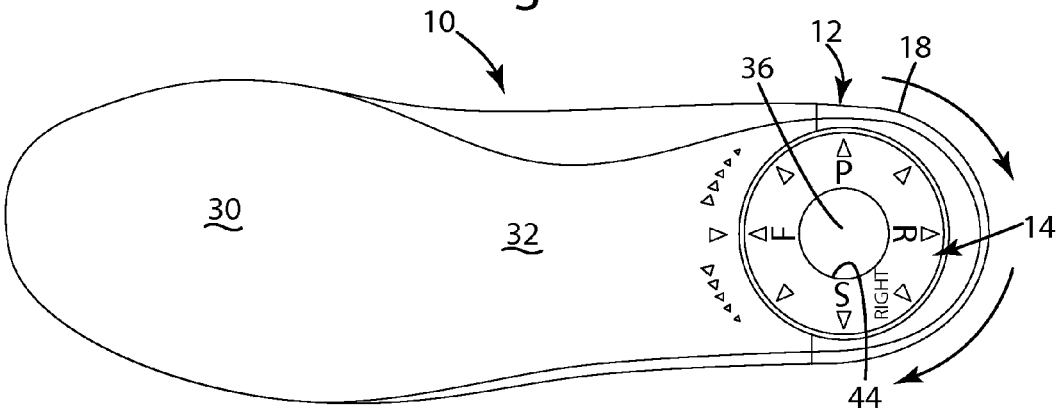
Figure 30A:
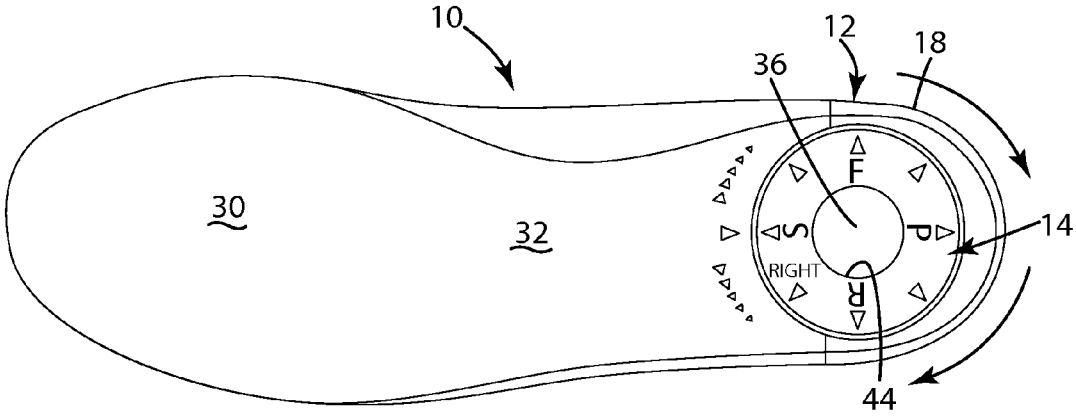
FIG. 30*a-b* are bottom plan views of the sole construction.
Figure 30B:
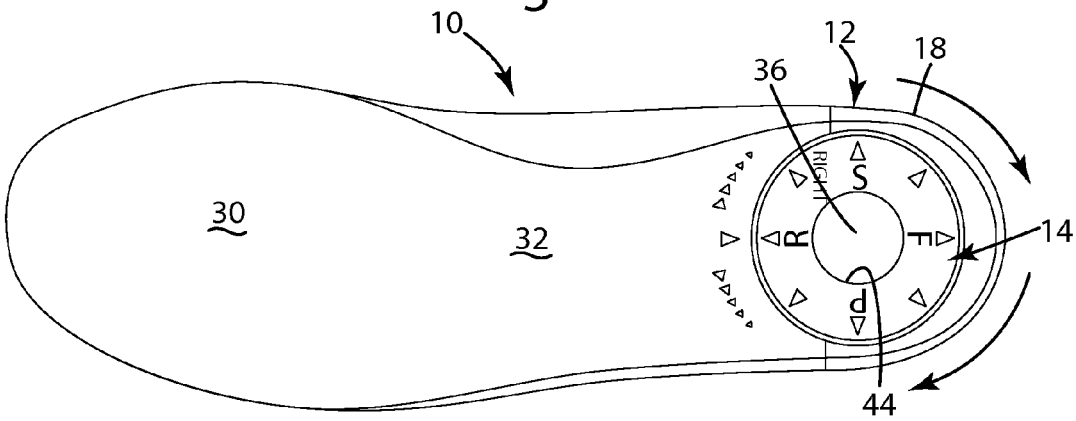

The present invention is primarily described in connection with a sole construction 10 configured to be incorporated into a right shoe. The sole construction for the left shoe may be a mirror image of the described right sole construction 10. Accordingly, the left cushion insert may be a mirror image of the right cushion insert 14. For example, FIG. 28 shows left and right assemblies of an alternative embodiment of the present invention.

In the embodiment of FIGS. 1-11, the midsole 12 provides the main cushioning body of the sole. The midsole 12 of this embodiment is a full-length midsole that follows the general shape of an article of footwear and is configured to be fitted into an upper above an outsole or other underlying sole component (See FIGS. 1 and 2). The midsole 12 of this embodiment is a single unitary construction that is essentially coextensive with the outsole, however, the midsole may be a collection of separate components or may be a partial midsole configured to extend through only one or more select portions of the sole. Referring again to the illustrated embodiment, the midsole 12 includes a forefoot region 30, an arch region 32 and a heel region 34. The forefoot region 30 is configured to support the wearer's forefoot. The arch region 32 may be shaped to provide an arch support. Although not shown, a shank or substantially rigid arch support may be added to the midsole in the arch region 32 if contours in the arch region of the midsole 12 are not sufficient to provide the desired level of arch support. If desired, a separate shank may be incorporated into the sole construction between the midsole 12 and the outsole or other locations. The heel region 34 defines a receptacle 18, which is configured to receive the cushion insert 14. Although this embodiment shows a single receptacle 18 in the heel region, the receptacle 18 may be located in other positions, such as in the forefoot region, and the midsole 12 may define a plurality of receptacles configured to receive a plurality of cushion inserts. For example, separate cushion inserts may be located in the heel region and in the forefoot region to provide adjustability in both areas of the sole. In the illustrated embodiment, the receptacle 18 is a generally disc-shaped void having a central post 36 (See FIGS. 2 and 4*a*-4*b*). The central post 36 is configured to receive the cushion insert 14 as described in more detail below. The size, shape and configuration of the central post 36 may vary from application to application to vary the characteristics of the sole construction 10. For example, the diameter of the post 36 may be increased or decreased to control the amount of support provide at the center of the heel region. The central post 36 is optional and the cushioning insert 14 may simply be fitted into a disc-shaped void when a central post 36 is not provided.

The receptacle 18 includes an interface surface 40 that is configured to engage the cushion insert 14 (See FIGS. 3*a-b* and 4*a-b*). The interface surface 40 may include a plurality of lobes 26 extending toward the cushion insert 14. The lobes 26 may be positioned around the interface surface 40 in a pattern of regular waves coinciding with angular sections of the receptacle 18. In the illustrated embodiment, the receptacle 18 includes eight lobes 26 arranged in a regular repeating pattern about the center of the interface surface 40. Although the lobes 26 of the illustrated embodiment are formed by smooth and continuous curved contours, the term "lobes" is used broadly to refer to essentially any contours, whether or not such contours are curved, smooth or run continuously together. The interface surface 40 of the receptacle may include a support layer 42, such as a thin layer of TPU or a harder EVA. The hardness of the support layer 42 may vary from application to application as desired. However, in the illustrated embodiment, the support layer 42 may have a durometer ranging between approximately 80-90 on the Asker A scale. The support layer 42 may be secured to the midsole 12. For example, the support layer 42 may be molded in situ to the midsole 12. As another example, the support layer 42 may be cemented or otherwise adhesively secured to the interface surface 40. The size, shape and configuration of the optional support layer 42 may be varied from application to application to provide the desired level of cushion/support while maintaining structural integrity. Further, the characteristics of the support layer 42 may be varied from region to region to provide regional variation in the characteristics of the sole.

The midsole 12 may be manufactured from essentially any material or combination of materials capable of providing the desired cushioning/support characteristics. In one embodiment, the midsole 12 is manufactured from polyurethane or EVA having the desired hardness/resiliency. The hardness of the midsole 12 may vary from application to application as desired. However, in the illustrated embodiment, the midsole 12 is manufactured from a single material having a durometer ranging between approximately 65-70 on the Asker C scale. The midsole 12 may be manufactured using essentially conventional molding techniques and apparatus. The midsole 12 may be injection molded as a single integral unit in which the receptacle 18 is formed during the molding process. The midsole 12 may alternatively be pre-manufactured (e.g. pre-molded) and then die cut or otherwise processed to form the receptacle 18. The midsole 12 may alternatively be manufactured from a plurality of multiple components, for example, with separate heel and forefoot portions. The separate components may be combined during manufacture, such as by compression molding or through the use of adhesives.

Figure 9A:
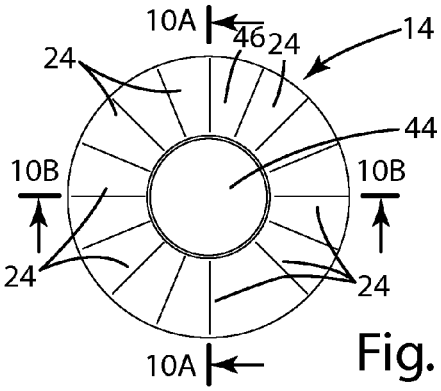
FIG. 9*a* is a top plan view of the cushion insert.
Figure 10A:
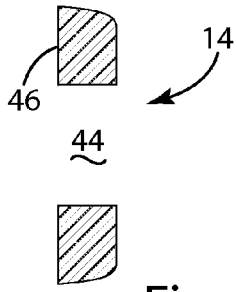
FIG. 10*a* is a sectional view of the cushion insert taken along line Xa-Xa of FIG. 9*a*.
Figure 10B:
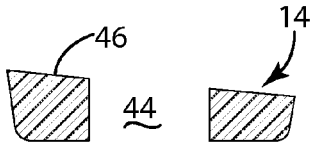
FIG. 10*b* is a sectional view of the cushion insert taken along line Xb-Xb of FIG. 9*b*.

The cushion insert 14 is configured to be removably fitted into the receptacle at a variety of different orientations (See FIGS. 5-8). In the illustrated embodiment, the cushion insert 14 is generally disc-shaped and is configured to be seated within the receptacle 18 (See FIGS. 2, 4*a* and 4*b*). Referring now to FIGS. 9*b* and 10*a-b*, the insert 14 defines a central hole 44 adapted to be fitted over central post 36. The central hole 44 and central post 36 may help to assist in aligning and/or retaining the insert 14 in the receptacle 18. The central post 36 and central hole 44 may, however, be eliminated or take on other configurations. For example, the central hole 44 and central post 36 may be configured to be snap-fitted together. Although not shown, the central post 36 may include a head (not shown) and the central hole 44 may define an enlarge space (not shown) to receive the head of the central post 36 when the cushion insert 14 is installed in the receptacle 18. As another example, the central post 36 and the central hole 44 may be shaped so that the insert 14 fits into the receptacle 18 only in select orientations. In this alternative embodiment, one of the two components may include a key and the other may include a plurality of slots that receive the key only when the insert 14 is in one of the permissible orientations.

The interface surface 46 of the cushion insert 14 includes a plurality of lobes 24 configured to be interfitted with the lobes 26 of the receptacle 18. One or more of the lobes 24 varies in size, shape or other characteristics from the remainder of the lobes 24 so that repositioning of the cushion insert 14 results in repositioning of the lobes 24 and therefore causes changes to the support/cushioning characteristics of the sole construction 10. In the illustrated embodiment, the lobes 24 and 26 are shaped to be closely interfitted with one another such that the only spaces occur in regions where the lobes 24 of the cushion insert 14 are intentionally truncated to provide adjustability. As perhaps best shown in FIG. 11*a*, the lobes 24 of the illustrated embodiment are truncated by a single common plane extending through the lobes 24 at an orientation selected to provide a uniform taper from full height lobes 24 on one side of the insert 14 to lobes of substantially less height at the opposite side. In different applications, the truncating plane may be disposed at alternative orientations as appropriate to provide the desired cushioning characteristics. Further, the lobes 24 need not be truncated by a single common plane, but may alternatively be truncated or otherwise varied as desired to provide the desired cushioning/support characteristics throughout the range of adjustment of the cushion insert.

Although the illustrated embodiment discloses truncated lobes, adjustability may be provided by varying essentially any characteristic of the cushion insert 14 or the lobes 24, such as size, shape, configuration and materials to provide the desired support/cushioning throughout the range of adjustability of the cushion insert 14. For example, the lobes may be manufactured from materials of different degrees of hardness. In an embodiment of this type, the cushion insert may be formed of lobes manufactured from different materials. Although the manufacturing process may vary, the different materials of the cushion insert may be cemented together, integrally molded using multiple shots or compression molded. As another example, a support layer (not shown) may be positioned over one or more of the lobes to provide the lobes with the desired characteristics. Although not shown, the support layer may be similar to support layer 42 of the receptacle 18. A firmer support layer may be provided over select lobes to provide enhanced firmness. A thinner support layer (or the absence of a support layer) over select lobes may provide reduced firmness in select regions. Variations in the thickness of the support layer may be used to provide the desired variations in lobe characteristics.

In addition to varying individual lobes 24 in the cushion insert 14 to provide adjustability, the contours and other characteristics of the midsole 12 and the cushion insert 14 may be varied from application to application. For example, variations in the thickness or materials of the midsole 12, the cushion insert 14 and/or the support layer 42, as well as changes in the size, shape, and configuration of the lobes 24 and 26 can be used to control the support/cushioning characteristics outside of the context of adjustability. In the illustrated embodiment, the lobes 24 and 26 transition from one lobe to the next smoothly following a continuous curve extending around the interface surfaces. When viewed from the end, the curve is generally sinusoidal. If desired, spacing may be provided between the lobes of one or both components. Also, one or more lobes 24 and 26 may be eliminated in the cushion insert to provide region(s) of reduced hardness. As another example, the lobes 24 and 26 may have different shapes, such as triangular, rectangular or square rather than curved profiles. Further, the shapes of interfitting lobes 24 and 26 need not be corresponding as shown in the illustrations. For example, a triangular lobe or a square lobe may be fitted into a curved void or other non-matching void shape.

Figure 2:
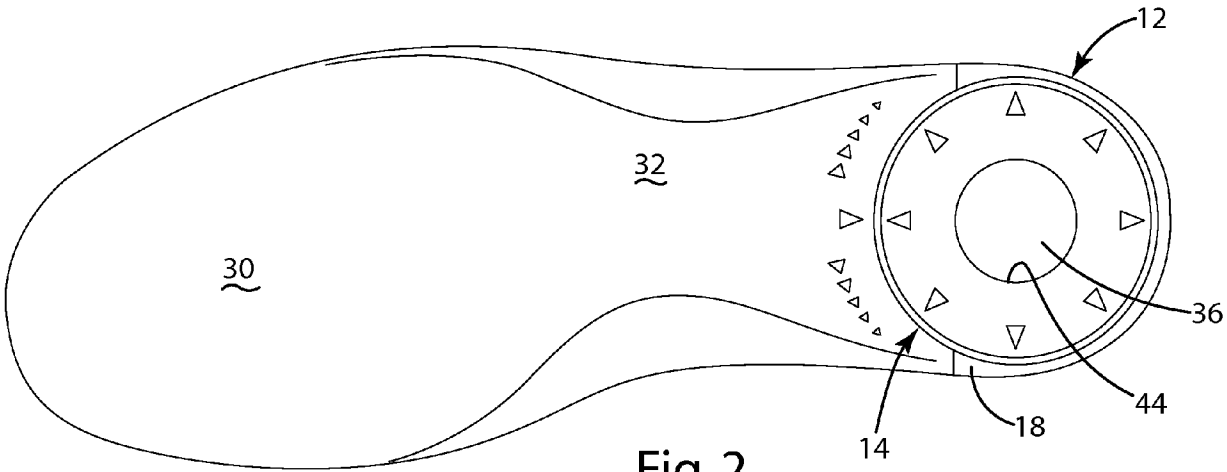
FIG. 2 is a bottom plan view of the sole construction.
Figure 4A:
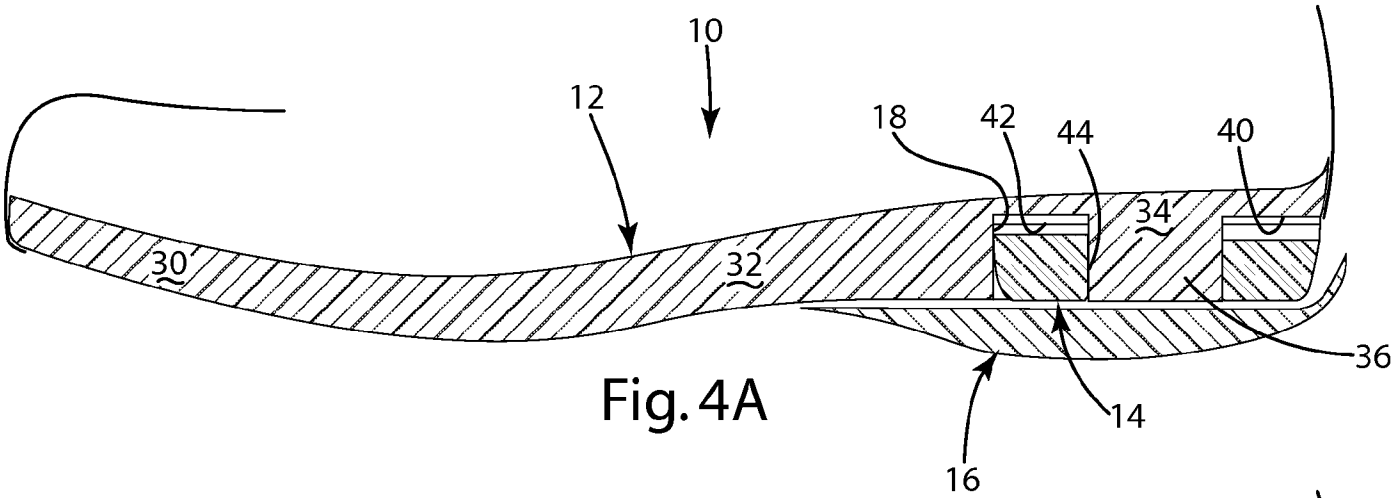
FIG. 4*a* is a sectional view of the sole construction taken along line IV-IV of FIG. 1 with the cushion insert in the supination position.
Figure 3A:
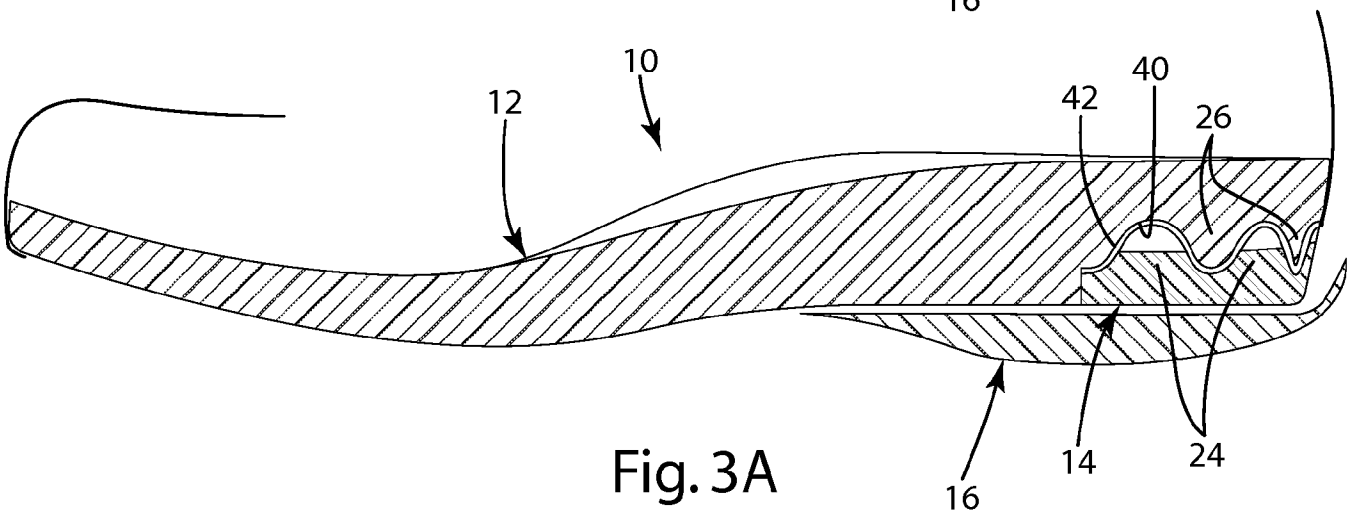
FIG. 3*a* is a side elevational view of the sole construction with the cushion insert in the supination position and the heel wedge shown in section.
Figure 3B:
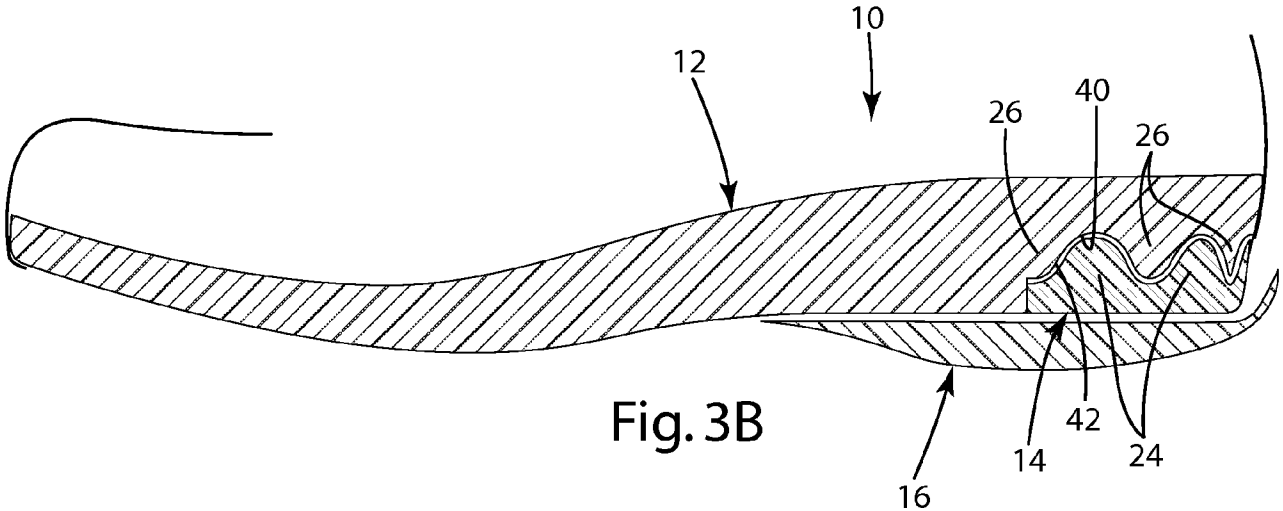
FIG. 3*b* is a side elevational view of the sole construction with the cushion insert in the pronation position and the heel wedge shown in section.
Figure 4B:
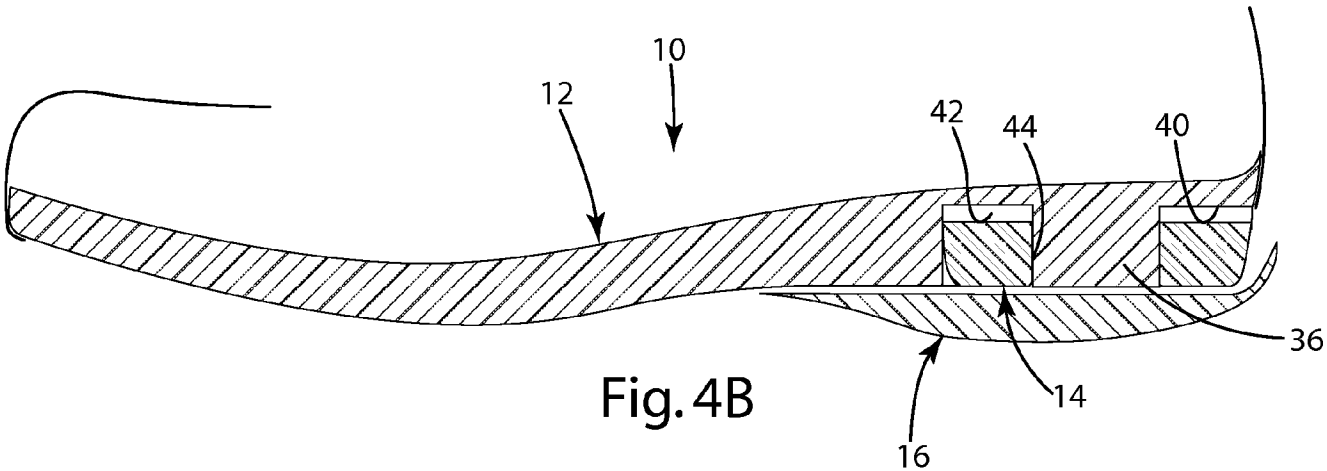
FIG. 4*b* is a sectional view of the sole construction taken along line IV-IV of FIG. 1 with the cushion insert in the pronation position and the support layer removed.
Figure 5:
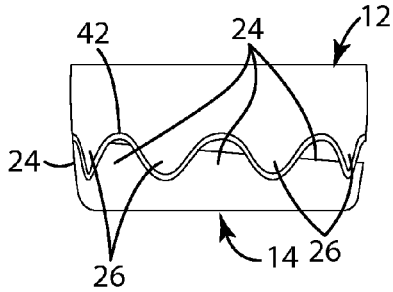
FIG. 5 is a rear view of the sole construction showing the cushion insert in the "pronation" position.
Figure 6:
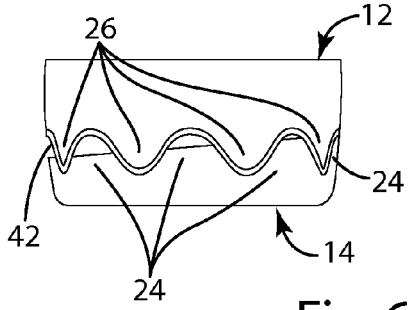
FIG. 6 is a rear view of the sole construction showing the cushion insert in the "supination" position.
Figure 8:
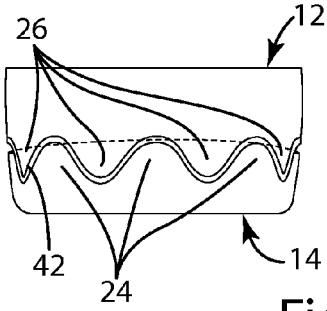
FIG. 8 is a rear view of the sole construction showing the cushion insert in the "regular" position.
Figure 7:
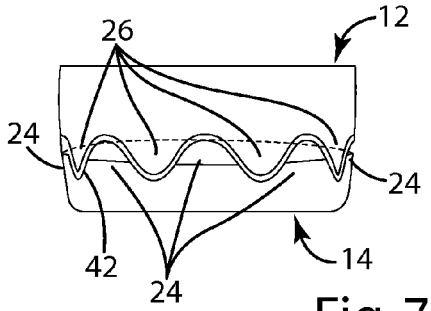
FIG. 7 is a rear view of the sole construction showing the cushion insert in the "firm" position.

The midsole 12 and cushion insert 14 may include graphics, printed material or other symbols that assist in adjusting the cushion insert 14. For example, as shown in FIG. 2, the midsole 12 may be provided with an alignment indicator 98 (in this case, an arrow) and the insert 14 may be provided with a plurality of similar alignment indicators 96 (in this case, a plurality of arrows) that show permissible orientations of the insert 14. The insert 14 may include text or symbols that work in conjunction with the alignment indicators 96 and 98 to provide a visual indication of the results of the cushion insert 14 orientation. For example, the words "PRONATION," "SUPINATION," "REGULAR," and "FIRM" may be printed on the insert adjacent to the appropriate alignment indicators 96 (See FIGS. 29*a*-30*b*). FIGS. 5-8 show the cushion insert 14 in the "pronation," "supination," "firm" and "regular" positions, respectively.

In the illustrated embodiment, the sole construction 10 includes a heel wedge 16 that provides additional cushioning and elevation in the heel region of the sole (See FIGS. 3*b* and 4*a*-*c*). The heel wedge 16 may be shaped to provide a cup-shaped surface to receive and support the undersurface of the midsole 12 and the insert 14 in the heel region. The heel wedge 16 is an optional component and may be eliminated, for example, when sufficient heel cushioning and elevation are provided by other sole components, such as an underlying outsole. In the illustrated embodiment, the heel wedge 16 is manufactured separately from the outsole and other sole components. If desired, the heel wedge 16 may be integrated into the outsole or other sole component underlying the midsole 12 and insert 14.

The midsole 12, insert 14 and heel wedge 16 may be incorporated into essentially any footwear construction. The assembly of FIGS. 1-11 may be removably fitted into an article of footwear, for example, by dropping the assembly through the foot opening into an upper and positioning it above the outsole. The heel wedge 16 may be permanently secured to the article of footwear even if the midsole 12 and insert 14 are removable. Alternatively, the assembly (excluding the cushion insert 14) may be permanently integrated into the construction, for example, by cementing the midsole 12 and heel wedge 16 in place. Although it is not strictly necessary for the cushion insert 14 to be removable, the user should be capable of adjusting the cushion insert 14 from one orientation to the next. For example, the cushion insert 14 need not be removable if it can be rotated from one orientation to the next without being removed.

Figure 18A:
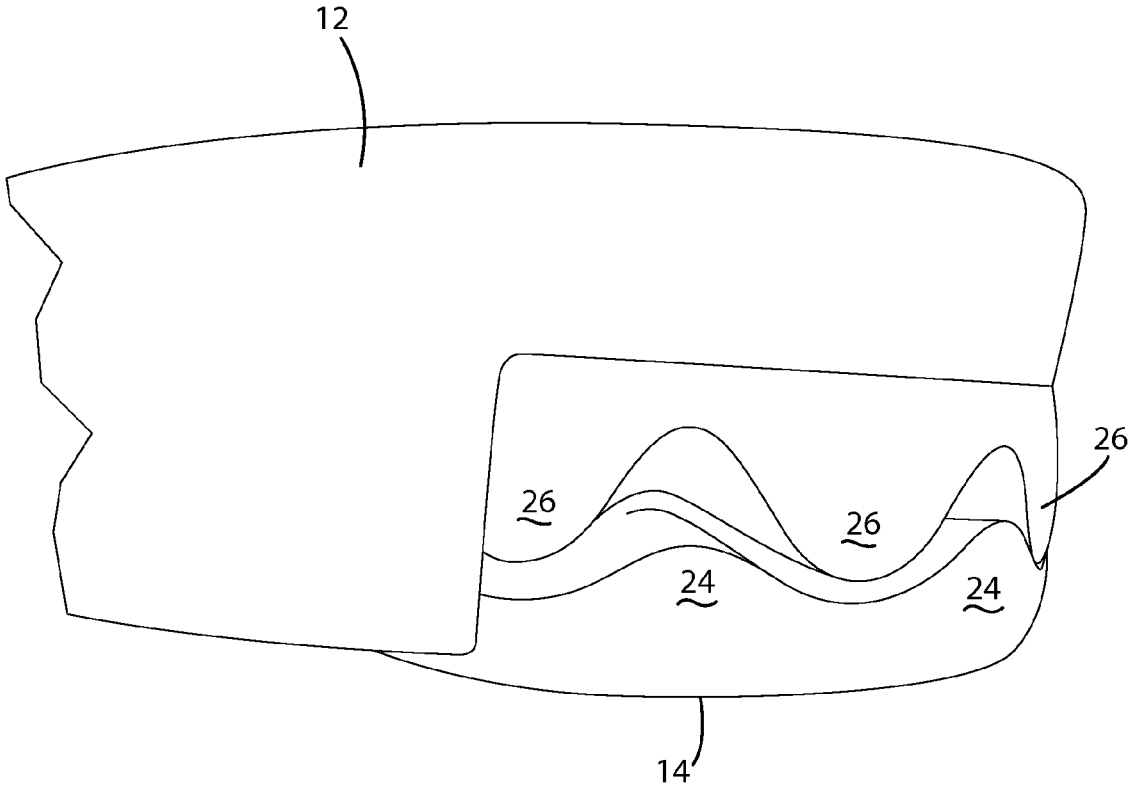
FIG. 18*a* a side elevational view of the sole construction with the cushion insert of FIGS. 1-11 in the supination position and the heel wedge shown in section.
Figure 18B:
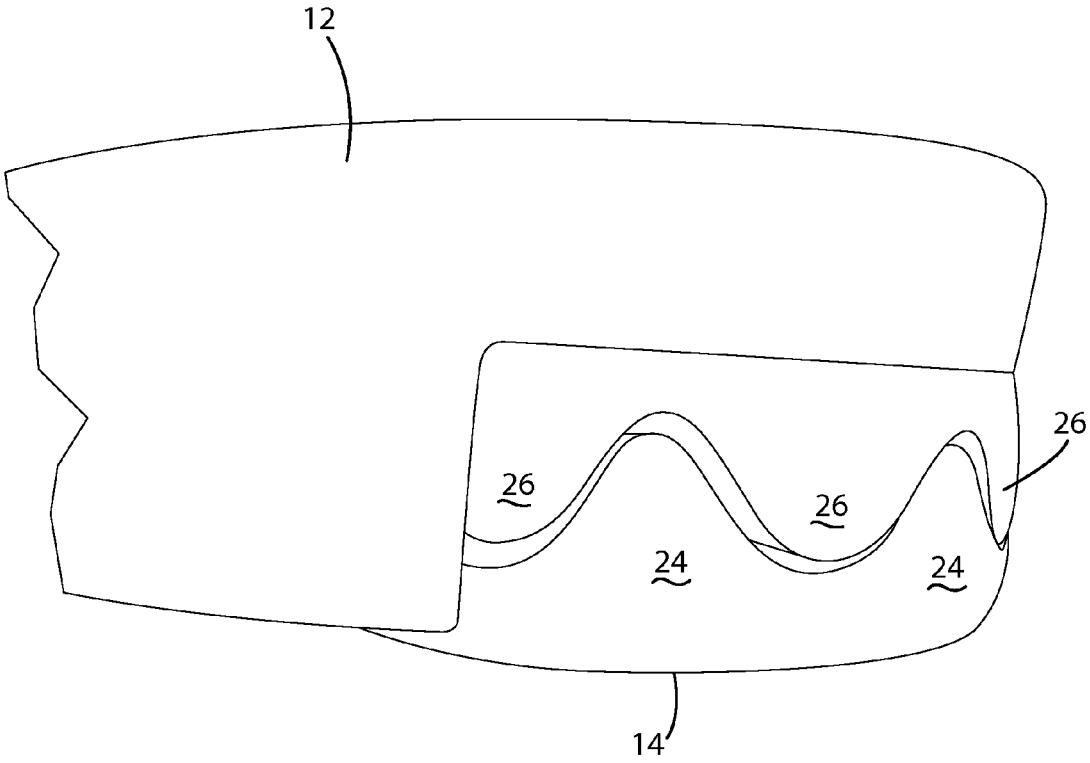
FIG. 18*b* is a side elevational view of the sole construction with the cushion insert of FIGS. 1-11 in the pronation position and the heel wedge shown in section.
Figure 18C:
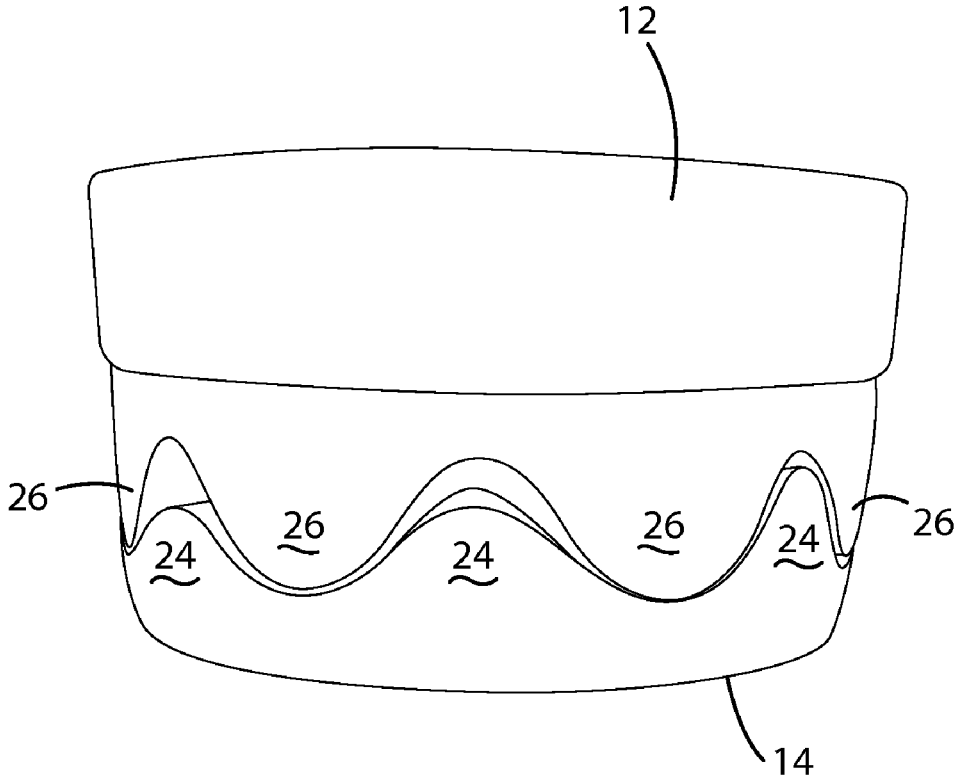
FIG. 18*c* is a rear view of the sole construction showing the cushion insert of FIGS. 1-11 in the "pronation" position.
Figure 18D:
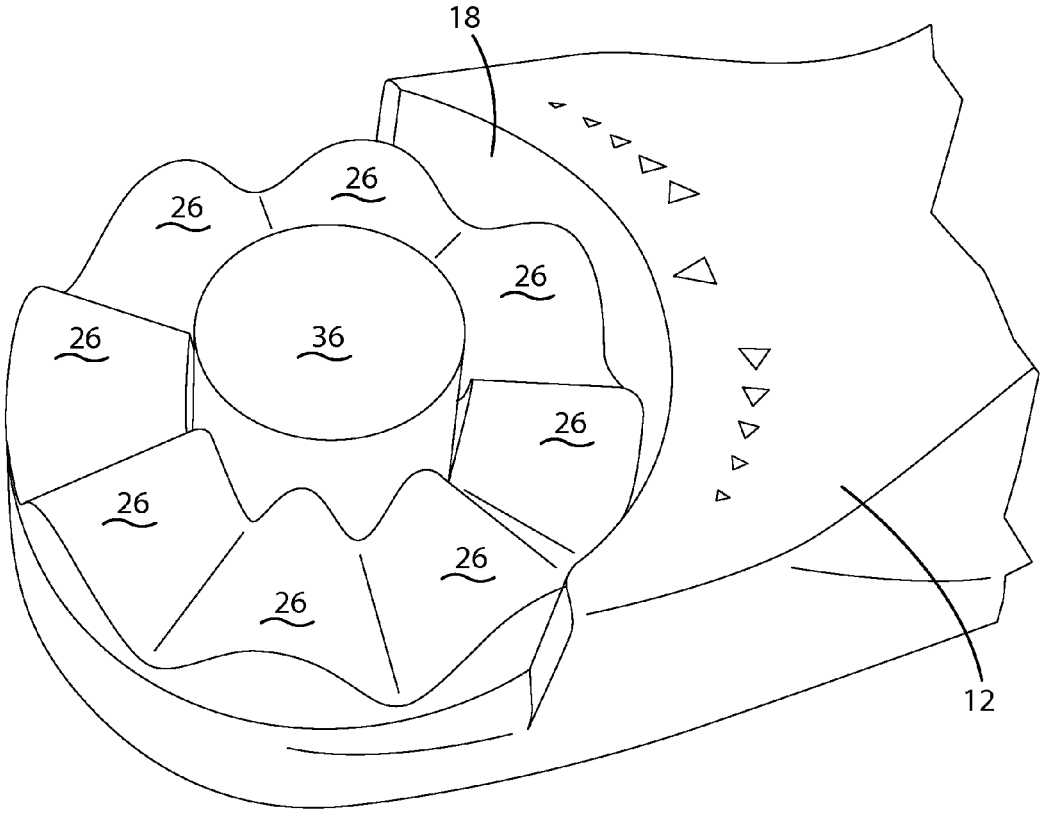
FIG. 18*d* is a top plan view of the sole construction showing the receptacle into which the cushion insert of FIGS. 1-11 is placed.
Figure 18E:
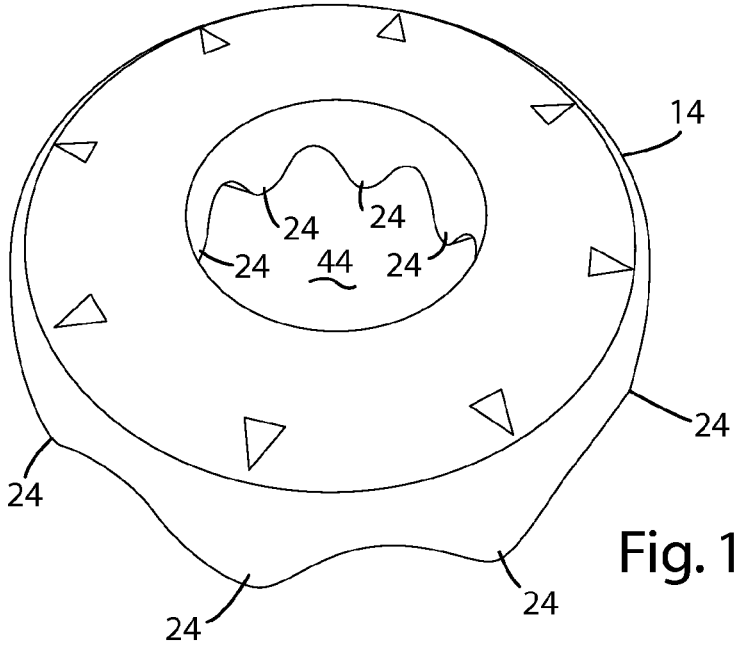
FIG. 18*e* is a bottom plan view of the cushion insert of FIGS. 1-11.

A plurality of drawings of a midsole and cushioning insert of an embodiment similar to that illustrated in FIGS. 1-11 are shown in FIGS. 18*a*-*e*. Although similar to the embodiment of FIGS. 1-11, the embodiment does not include, among other things, support layer 42. Further, the lobes of the cushion insert vary in height rather than being truncated by a plane as in the embodiment of FIGS. 1-11. The drawings are labeled with reference numbers corresponding to the reference numbers used in connection with FIGS. 1-11. FIGS. 18*a*-*e* depict the cushion insert 14 that is installed in the midsole 12. As can be seen, the cushion insert 14 is fitted over post 36. FIG. 18*a* shows the right side of the heel region of the prototype with the cushion insert in a first position. FIG. 18*b* shows the right side of the heel region of the prototype with the cushion insert in a second position. FIG. 18*c* shows the heel region of the prototype from the rear with the cushion insert 14 is a first position. FIG. 18*i* shows the heel portion of the midsole 12 with the cushion insert 14 removed. FIG. 18*k* shows the bottom of the cushion insert.

Figure 14:
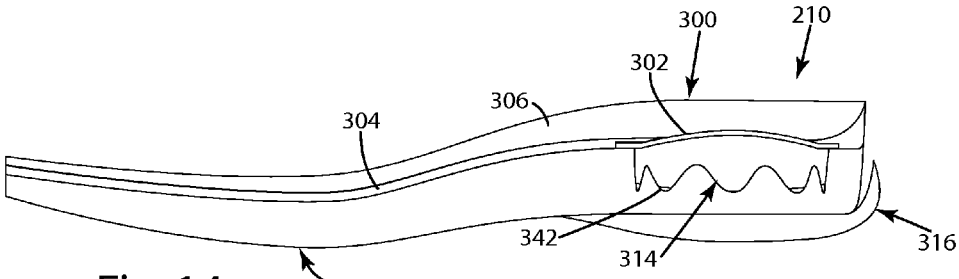
FIG. 14 is a sectional view of the alternative sole construction taken along line XIV-XIV of FIG. 12.
Figure 16:
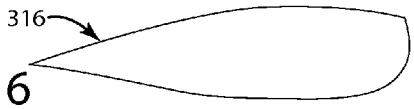
FIG. 16 is a side elevational view of the heel wedge.
Figure 15:
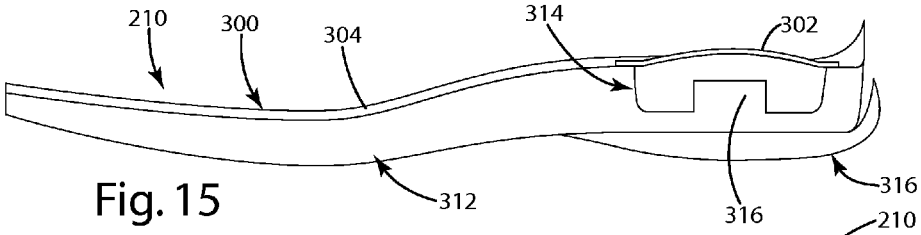
FIG. 15 is a partially section view of the alternative sole construction taken along line XV-XV of FIG. 12.
Figure 12:
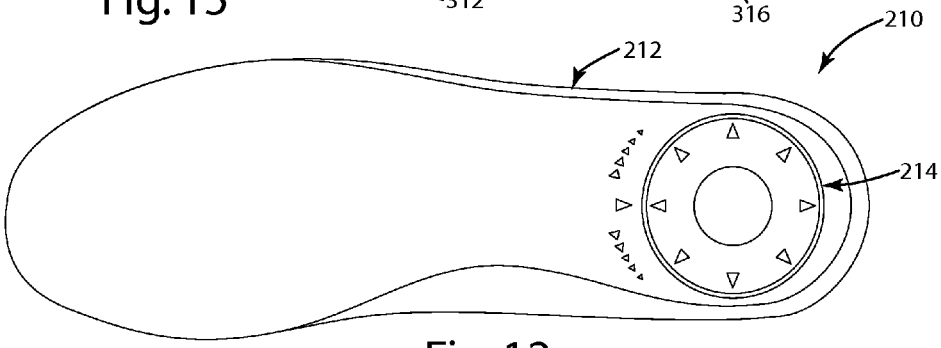
FIG. 12 is a top plan view of a sole construction in accordance with an alternative embodiment of the present invention.

An alternative embodiment is shown in FIGS. 12-17. In this alternative embodiment, the sole construction 210 is configured so that the cushion insert 214 is accessible from the top surface of the midsole 212 (See FIG. 12). As shown in FIG. 15, the sole construction 210 of this embodiment generally includes a midsole 212, a cushion insert 214 and a heel wedge 216. The midsole 212 is largely identical to midsole 12 described above. However, the receptacle 218 opens upwardly so that the cushion insert 214 is inserted into the midsole 212 from the top, thereby facilitating adjustment of the cushion insert 214 without removal of the midsole 212 from the shoe. Further, the central post 236 of this embodiment is configured so that it does not extend entirely through the cushion insert 214. Rather, the cushion insert 214 defines a central bore 244 that extends into the cushion insert 214 from the interface surface 246. The central post 236 may include a head (not shown) and the central bore 244 may define a corresponding enlarged void (not shown) that permitted the cushion insert 214 to be snap-fitted onto the central post 236. The heel wedge 216 is essentially identical to heel wedge 16 described above. The heel wedge 216 may be incorporated directly into the midsole 212, if desired.

Figure 13:
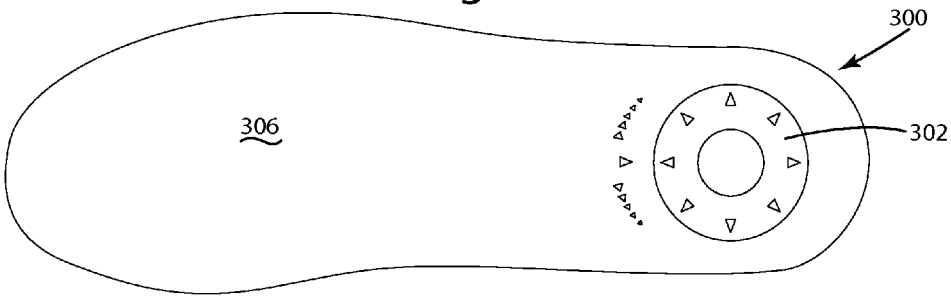
FIG. 13 is a top plan view of a sock liner of the alternative sole construction.
Figure 17:
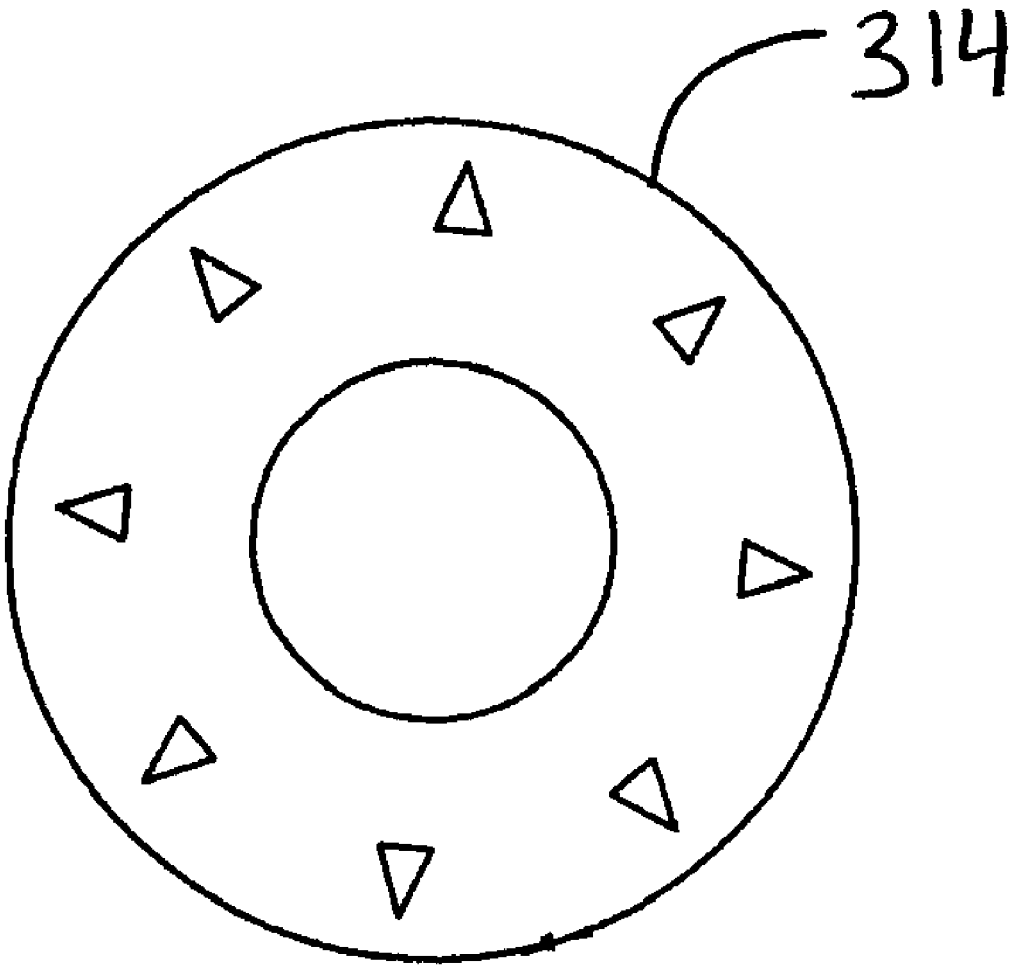
FIG. 17 is a top plan view of a cushion insert.

This alternative embodiment may also include an optional sock liner 300 (See FIGS. 13 and 14). The design and configuration of the sock liner 300 may vary from application to application. For example, the sock liner may be a conventional laminated construction (e.g. assembled from a plurality of different layers) or it may be a conventional unitary construction. In the illustrated embodiment, the sock liner 300 is a laminated construction and generally includes a cushion layer 304 and a cover layer 306. The cushion layer 304 of this embodiment may be manufactured from essentially any cushioning material, such as EVA, polyurethane or gel. The cover layer 306 of this embodiment may be manufactured from a soft, yet durable cloth or fabric material, such as cotton, wool and polypropylene blends. If desired, the sock liner 300 may be treated with antimicrobial, anti-odor and/or other functional treatments. As shown, the sock liner 300 may include a window 302 that permits viewing of the cushion insert 214 when the sock liner 300 is installed in the shoe. The window 302 may simply be an opening in the sock liner 300 or it may be filled with a transparent or translucent material. Although shown only in connection with the embodiments of FIGS. 12-17 and 20-28, essentially any construction may include an optional sock liner. In applications where the cushion insert is fitted into the undersurface of the midsole, there may be no need for a window in the sock liner.

The present invention may be incorporated into essentially any type of footwear, including but not limited to shoes, boots, sandals, slippers and athletic wear. Further, the present invention may be incorporated into essentially any footwear construction. For example, the sole construction may be incorporated into direct attach, welt, cement, stroble, California, opanka, lasted, slip lasted and other footwear constructions. The entire sole construction may be removably fitted into a void in an outsole, midsole or other sole component. Alternatively, select components of the present invention, such as the midsole and heel wedge, may be secured to the remainder of the sole. In this alternative, the cushion insert may be removable (or at least adjustable within the receptacle). If an optional sock liner is included in the construction, it will typically be removable if its removal is necessary to provide access to the cushion insert.

Figure 19A:
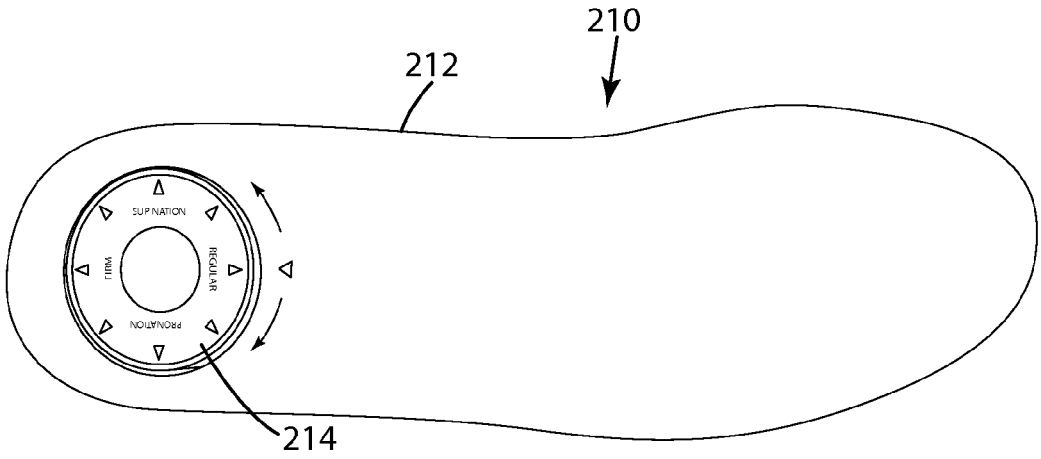
FIG. 19*a* is a top plan view of a sole construction in accordance with an embodiment shown in FIGS. 12-17.
Figure 19B:
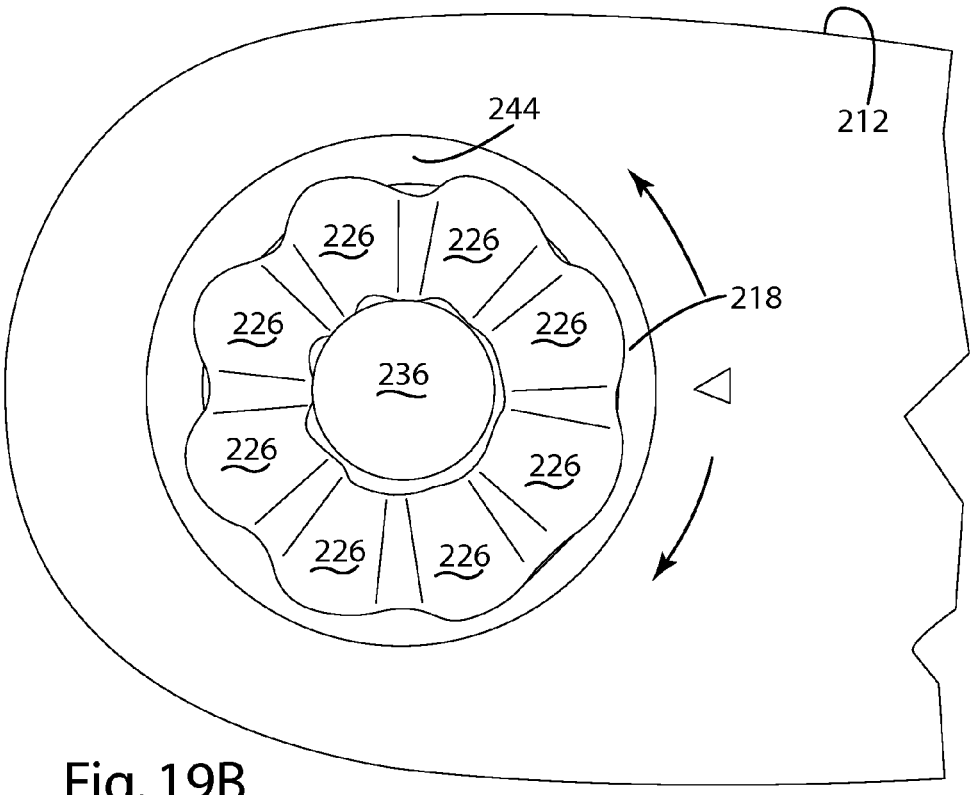
FIG. 19*b* is a top plan view of the receptacle into which the cushion insert is placed.
Figure 19C:
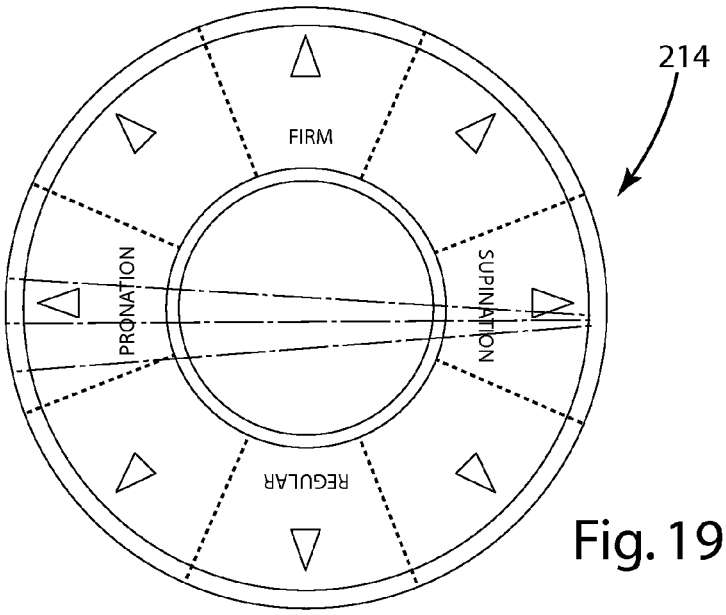
FIG. 19*c* is a top plan view of the cushion insert shown in FIGS. 12-17.
Figure 19D:
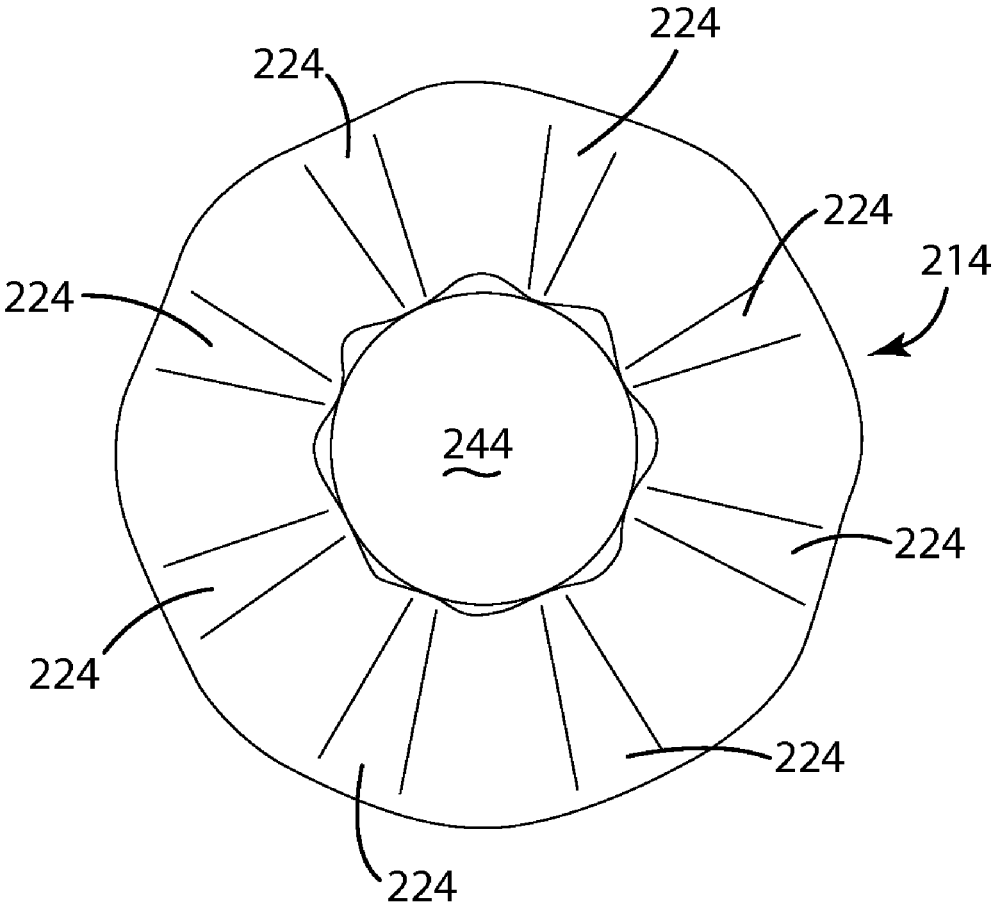
FIG. 19*d* is a bottom plan view of the cushion insert shown in FIG. 12-17.
Figure 20:
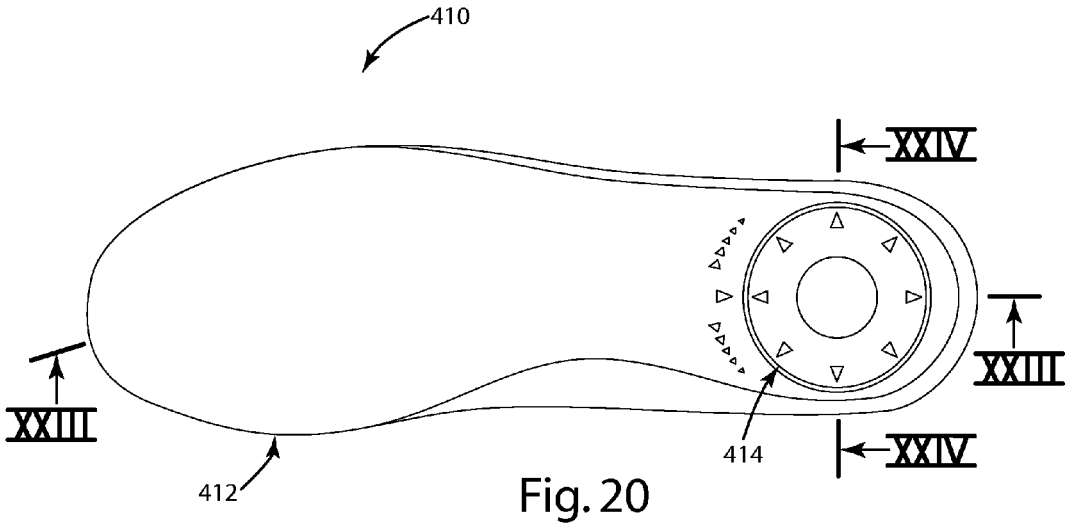
FIG. 20 is a top plan view of a sole construction of a second alternative embodiment.

A plurality of drawings of a midsole and cushioning insert of an embodiment similar to that illustrated in FIGS. 12-17 are shown in FIGS. 19*a-d*. Although similar to the embodiment of FIGS. 12-17, the embodiment does not include, among other things, support layer 242. Further, the lobes of the cushion insert vary in height/shape rather than being truncated by a plane as in the embodiment of FIGS. 12-17. The drawings are labeled with reference numbers corresponding to the reference numbers used in connection with FIGS. 12-17. FIG. 19*a* shows the top of the prototype showing the cushion insert 214 installed in the midsole 212. FIG. 19*b* shows the heel region of the midsole 212 with the cushion insert 214 removed. FIG. 19*c* shows the top of the cushion insert. FIG. 19*d* shows the bottom of the cushion insert.

Figure 21:
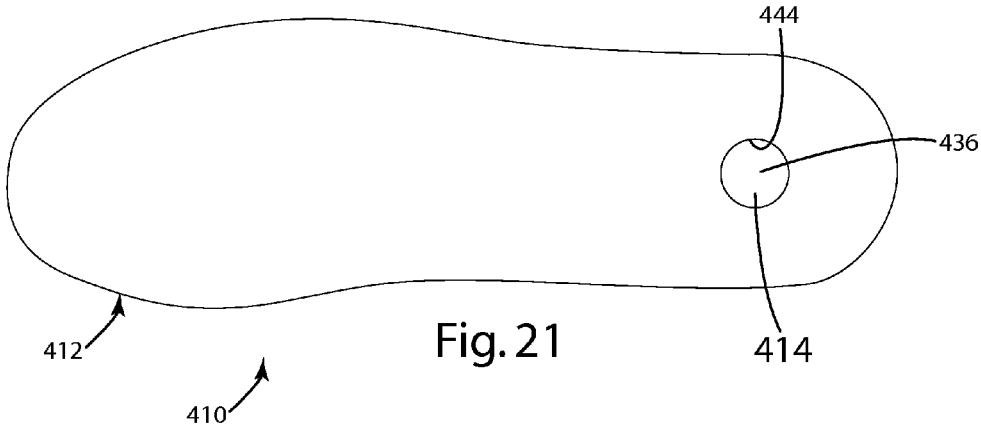
FIG. 21 is a bottom plan view of the sole construction of the second alternative embodiment.
Figure 23:
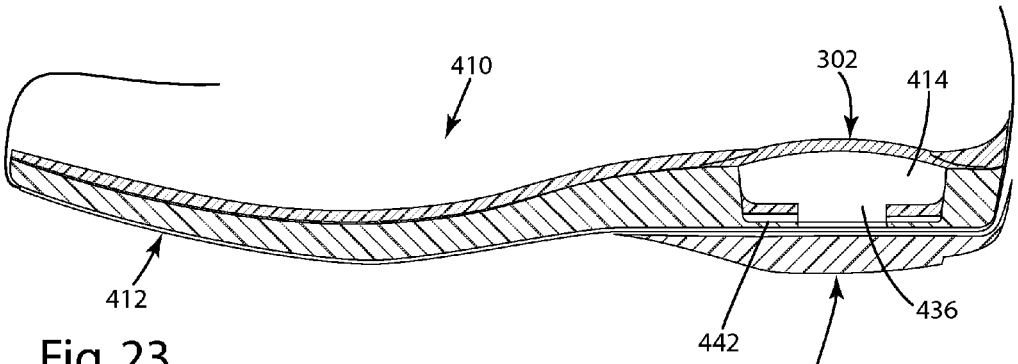
FIG. 23 is a sectional right side elevational view of the sole construction of the second alternative embodiment taken along line XXIII-XXIII of FIG. 20.
Figure 22:
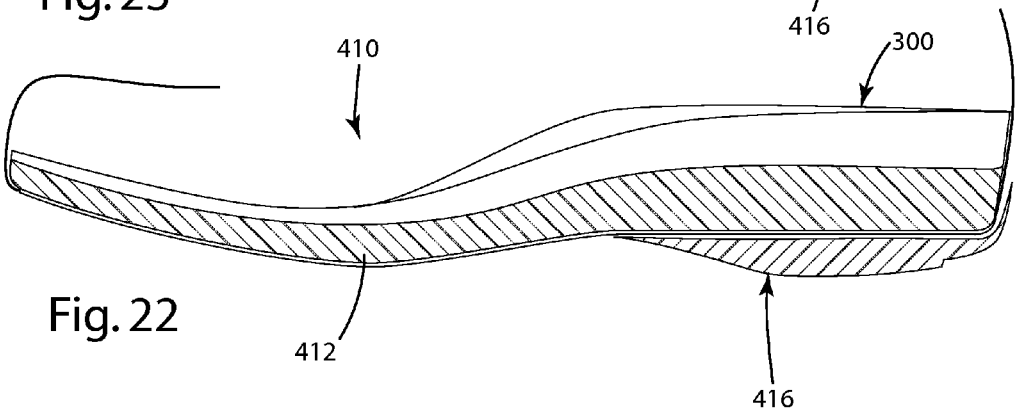
FIG. 22 is a right side elevational view of the sole construction of the second alternative embodiment.
Figure 24:
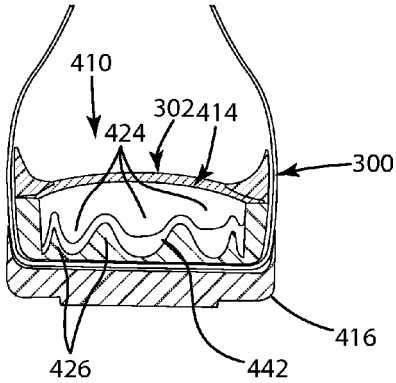
FIG. 24 is a sectional rear view of the sole construction of the second alternative embodiment taken along line XXIV-XXIV of FIG. 20.
Figure 25A:
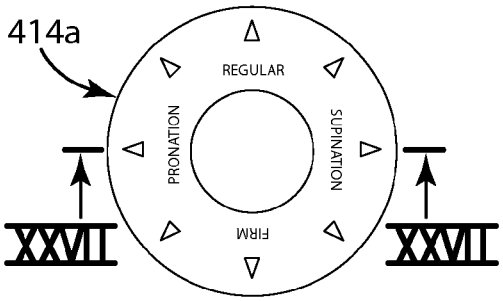
FIG. 25*a* is a top plan view of the right cushion insert of the second alternative embodiment.
Figure 26A:
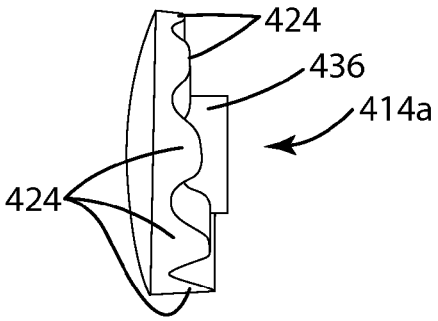
FIG. 26*a* is a right side elevational view of the right cushion insert of the second alternative embodiment.
Figure 25B:
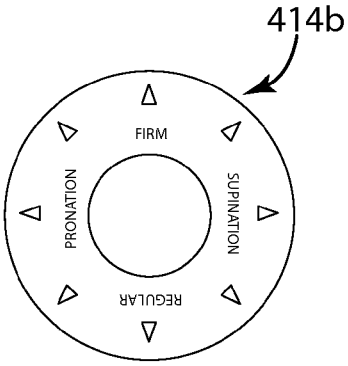
FIG. 25*b* is a top plan view of the left cushion insert of the second alternative embodiment.
Figure 26B:
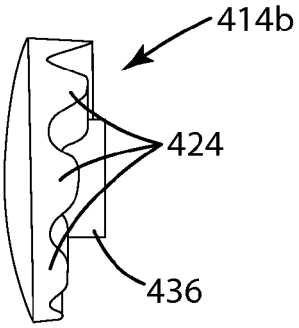
FIG. 26*b* is a right side elevational view of the left cushion insert of the second alternative embodiment.
Figure 27:
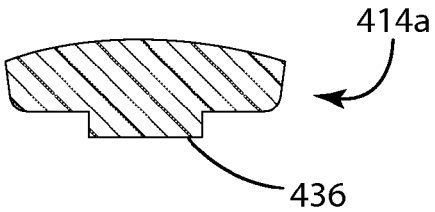
FIG. 27 is a sectional view of the right cushion insert taken along line XXVII-XXVII of FIG. 25*a*.

A second alternative sole construction 410 is shown in FIGS. 20-28. This embodiment is generally identical to the embodiment of FIGS. 12-17, except to the extent described. As shown, this embodiment includes a cushion insert 414 that is installed into the upper surface of the midsole 412. The cushion insert 414 differs from cushion insert 214 primarily in that it includes a post 436 configured to be fitted into a corresponding alignment hole 444 in the midsole 412 (See FIGS. 23 and 27). If desired, the alignment hole 444 may extend entirely through the midsole 412 such that the post 436 is visible from the bottom of the midsole 412 as shown in FIG. 21. Alternatively, the alignment hole 444 may be replaced by a shallower hole (not shown) that extends into, but not through, the midsole 412. Right and left cushion inserts 414*a* and 414*b*, respectively, are shown in FIGS. 25*a-b* and 26*a-b*. As shown, the right and left cushion inserts 414*a* and 414*b* are essentially mirror images of each other. Referring now to FIGS. 22-24, the heel wedge 416, midsole 412, cushion insert 414 and sock liner 300 are assembled in essentially the same method as the alternative embodiment shown in FIGS. 12-17. FIG. 28 shows the sole construction installed in left and right articles of footwear. In this illustration, the cushion inserts 414*a* and 414*b* are installed in the "pronation" position.

A third alternative sole construction 510 is shown in FIGS. 31-34. This alternative embodiment is intended for, but not limited to, use in loafers and other low profile footwear constructions. In the illustrated embodiment, the sole 510 includes a sole component or midsole 512 having a cushion insert 514, which may be substantially similar to midsoles 12, 212 and 412 and cushion inserts 14, 214 and 414 described in detail above. Midsole 512 includes a differentiated heel portion 512*a* adapted to be dropped or inserted into a loafer 516 or other type of footwear having a corresponding receptacle 550 to receive heel portion 512*a*. In this embodiment, the differentiated heel portion 512*a* is marked by a substantial transition 513 from the arch region 515 to the heel region 517 of the midsole 512 (See FIG. 32). The transition 513 permits the heel portion 512*a* to drop down into the receptacle 550.

Although suitable for use with a wide range of footwear styles, the present invention is illustrated in connection with a loafer 516. The loafer 516 is generally conventional except as otherwise noted. In the illustrated embodiment, loafer 516 includes an upper 546 and an outsole 548 adapted to engage and support the undersurface of midsole 512 (See FIG. 31). At a heel region 534 of loafer 516, outsole 548 forms a heel 548*a*, which provides additional elevation in heel region 534 of the loafer. Heel 548*a* is substantially hollow and defines receptacle 550 of sufficient size and shape to receive the heel portion 512*a* of the midsole 512. In the illustrated embodiment, receptacle 550 is formed as a cup-shaped void or opening defined in an upper surface of outsole 548.

Figure 31:
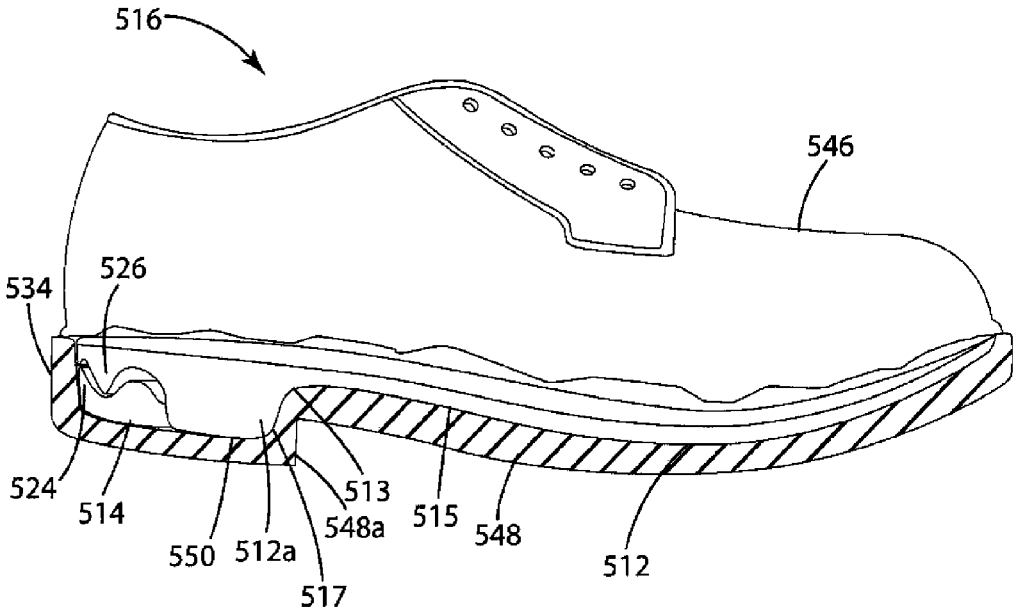
FIG. 31 is a sectional side elevational view of a shoe construction of a third alternative embodiment.
Figure 32:
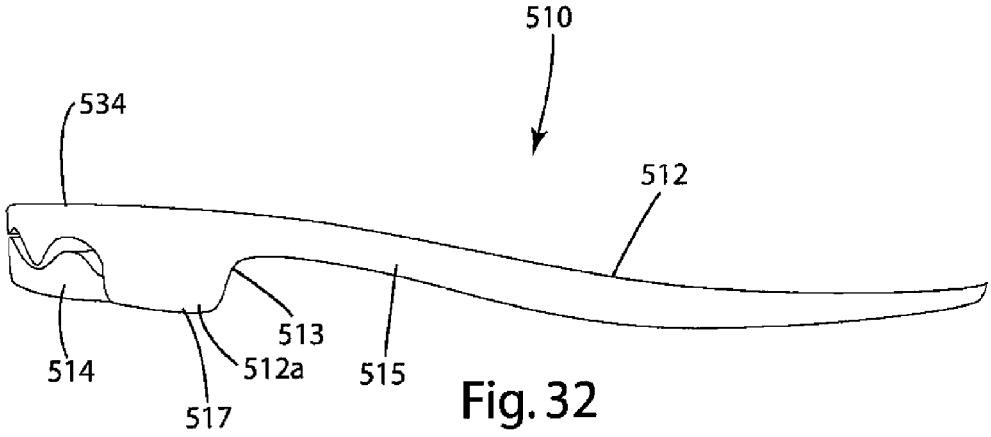
FIG. 32 is a side elevational view of the sole of the third alternative embodiment.

As shown in FIG. 31, midsole 512 is formed to engage and mate with outsole 548. Specifically, heel portion 512*a* of midsole 512 is formed as a protrusion or extension at the heel region of midsole 512 that corresponds to receptacle 550 of outsole 548, such that midsole 512 may be dropped or inserted into loafer 516 to easily engage outsole 548 in the proper orientation. The resulting configuration of heel portion 512*a* in receptacle 550 may reduce the overall thickness of the sole and may reduce the possibility of the midsole 512 sliding or otherwise shifting in loafer 516. In the illustrated embodiment, heel portion 512*a* is formed integrally with midsole 512. However, heel portion 512*a* may be manufactured separately from midsole 512 and later attached.

Optionally, midsole 512 may include at least one contoured surface, which may, among other things, vary the support characteristics of shoe construction 510. For example, midsole 512 may define spherical dimples or protrusions or recesses 552 on a bottom surface thereof, such as recesses 552 shown in FIG. 34, which may increase the flexibility of midsole 512.

As stated above, midsole 512 and cushion insert 514 may otherwise be substantially similar to the embodiments described herein, such that movement of the cushion insert provides varying support characteristics. In the illustrated embodiment, midsole 512 includes a receptacle in a bottom surface thereof for receiving cushion insert 514 (see FIG. 33). The bottom surface of the receptacle includes a plurality of lobes 526, while the top surface of cushion insert 514 includes a plurality of lobes 524. Lobes 524 and 526 are interfitted when the cushion insert 514 is installed in the receptacle. Like lobes 24 and 26 discussed above, lobes 524 and 526 may be of different shapes or heights so that they provide different support/cushioning characteristics. In the illustrated embodiment, cushion insert 514 is located at the heel region of midsole 512 in heel portion 516. However, the cushion insert 514 or additional cushion inserts may be positioned at other locations on the midsole 512.

Figure 33:
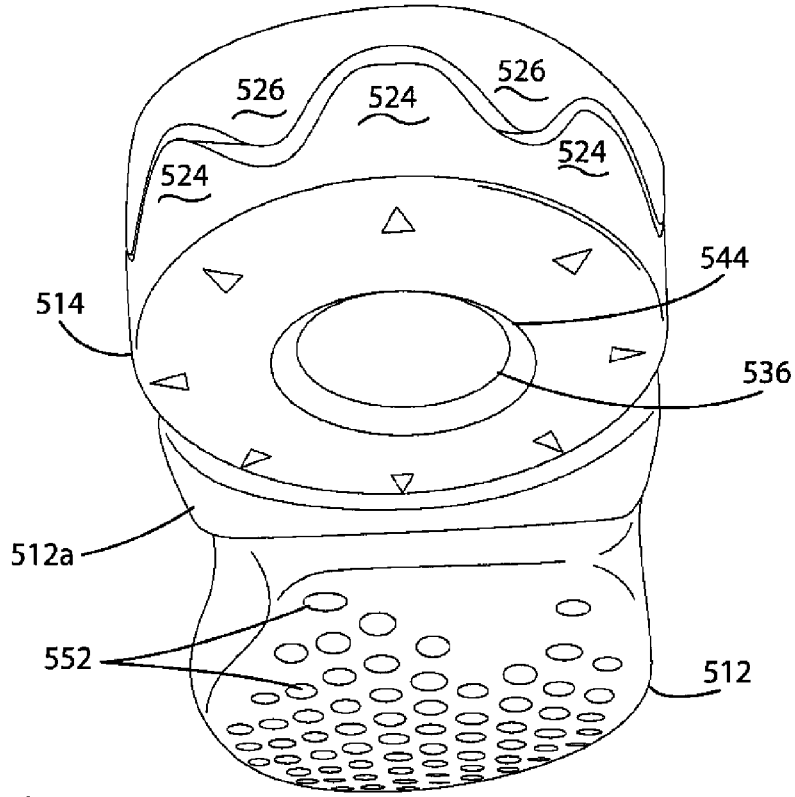
FIG. 33 is a rear perspective view of the sole.
Figure 34:
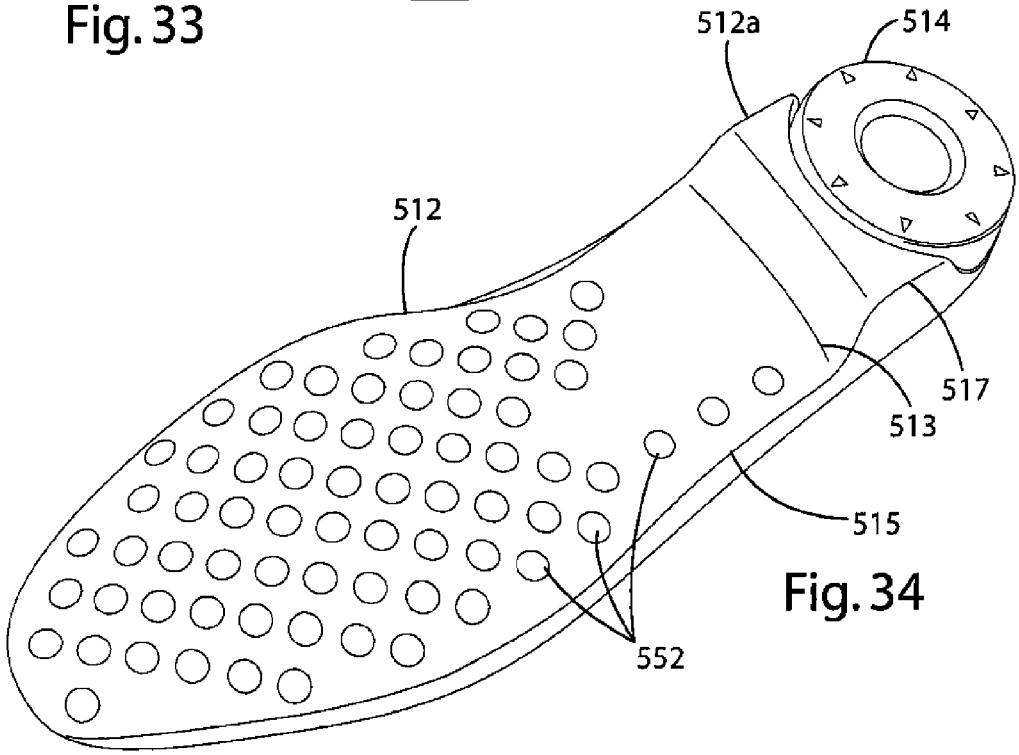
FIG. 34 is a bottom perspective view of the sole.

In this embodiment, the sole 510 may include structure to facilitate and maintain alignment between the cushion insert 514 and the mating sole component (e.g. midsole 512). As shown in FIGS. 33 and 34, cushion insert 514 includes a post 536 configured to be fitted into a corresponding alignment hole 544 in the midsole 512. Post 536 and alignment hole 544 may be largely identical to the posts and alignment holes discussed in the embodiments above. For example, alignment hole 544 may extend entirely through the midsole 512 such that the post 536 is visible from the bottom of the midsole 512. Alternatively, the alignment hole 544 may be replaced by a shallower hole (not shown) that extends into, but not through, the midsole 512. In embodiments where an alignment structure is desired, these alternative alignment constructions may be replaced by essentially any structure capable of providing suitable alignment.

In a fourth alternative embodiment, a construction is provided in which access to the cushion insert 614 for adjustment (and other purposes) is achieved through manipulation of a surrounding sole component. In the embodiment illustrated in FIGS. 35-39, the cushion insert 614 is made accessible by bending or pivoting a heel portion of the outsole 648 away from the midsole 612. As shown, the shoe construction 610 includes a midsole 612 and a cushion insert 614, which may be substantially similar to midsole 12 and cushion insert 14 described in detail above. Shoe construction 610 includes an upper 646 and an outsole 648 adapted to receive and support midsole 612. A portion 648*a* of outsole 648 is adapted to bend or pivot away from midsole 612 to expose cushion insert 614, such that cushion insert 614 may be removed, replaced or adjusted to vary the support characteristics provided by the insert 614 (See FIGS. 35-38).

Figure 37:
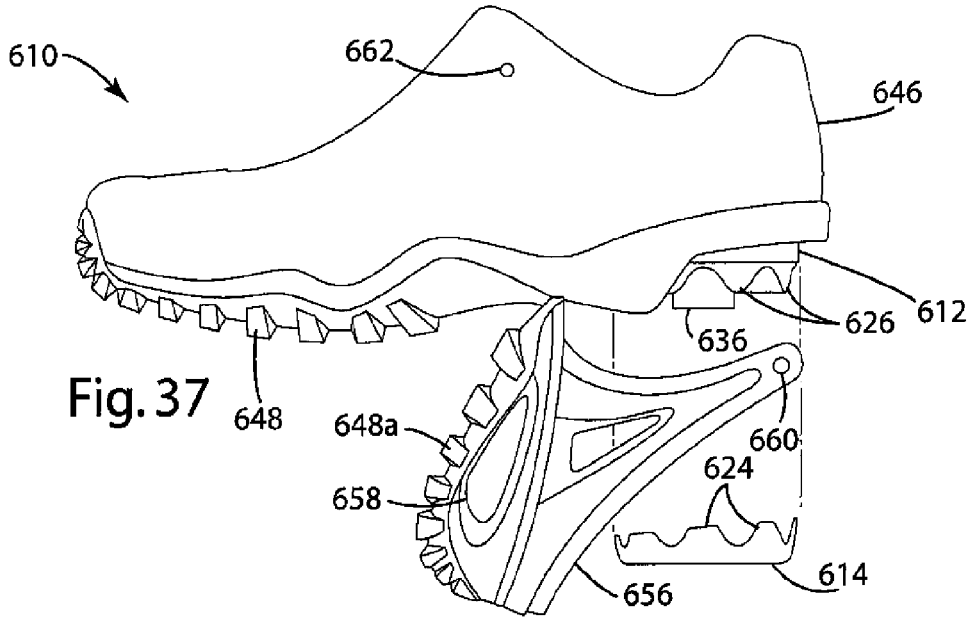
FIG. 37 is a side elevational view of the fourth alternative embodiment, shown with the outsole pivoted to an open position and the cushion insert removed from the sole.

In the illustrated embodiment, midsole 612 defines a receptacle in its bottom surface adapted to receive cushion insert 614. In the illustrated embodiment, the bottom surface of the receptacle includes a plurality of lobes 626, while the top surface of cushion insert 614 includes a plurality of corresponding or interfitting lobes 624 (See FIGS. 37 and 39). Lobes 624 and 626 may vary in shape or size so that they provide different support/cushioning characteristics. As a result, cushion insert 614 may be removed, rotated and replaced in the receptacle of midsole 612 to provide different support characteristics. As shown in FIGS. 37 and 38, cushion insert 614 includes a post 636 configured to be fitted into a corresponding alignment hole 644 in the midsole 612, which may be substantially similar or identical to post 36 and alignment hole 44 discussed above. In those embodiments where an alignment structure is desired, the post 636 and alignment hole 644 may be replaced by essentially any structure capable of providing suitable alignment.

Figure 36:
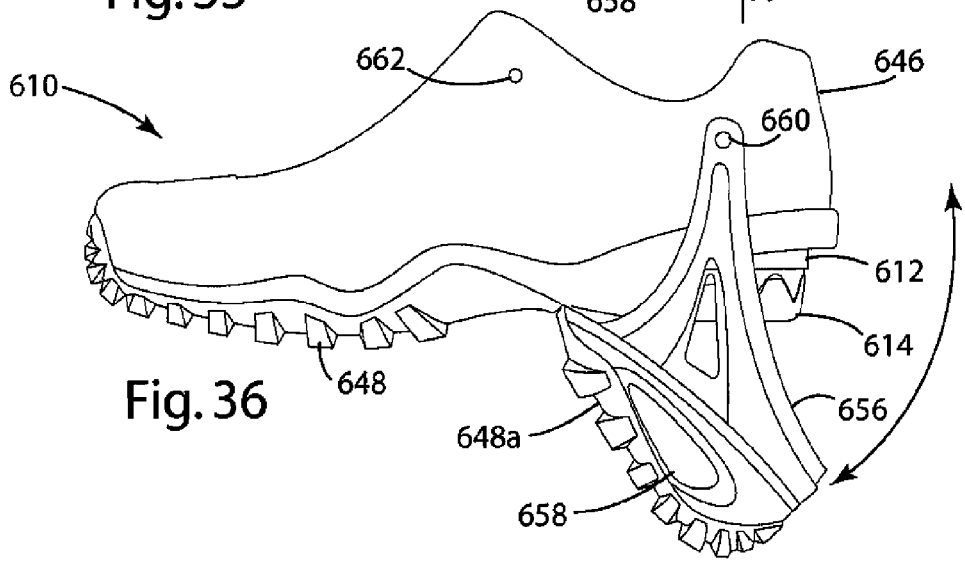
FIG. 36 is a side elevational view of the fourth alternative embodiment, shown with the outsole pivoted to a partially open position.

Portion 648*a* of outsole 648 is adapted to engage and support the bottom surface of cushion insert 614 when cushion insert 614 is inserted in the receptacle of midsole 612. An outsole would generally cover and block access to cushion insert 614, for example, in the manner of outsole 648 at the forefoot region of shoe construction 610. However, as shown in FIGS. 36 and 37, portion 648*a* of outsole 648 bends or pivots away from midsole 612 to provide access to cushion insert 614. When outsole portion 648*a* is pivoted open, cushion insert 614 may be removed, rotated and replaced in midsole 612 without having to remove the entire midsole from shoe construction 610 or to remove the shoe from the wearer's foot. In the illustrated embodiment, only the outsole portion 648*a* covering or supporting cushion insert 614 is adapted to pivot. Alternately, the entire outsole 648 may pivot or otherwise move away from midsole 612.

When cushion insert 614 is inserted in the receptacle of midsole 612 in the desired position, portion 648*a* pivots toward midsole 612 to a closed, non-pivoted position. Outsole portion 648*a* is adapted to be retained in a non-pivoted position, for example, at upper 646 or at midsole 612. In the illustrated embodiment, outsole portion 648*a* includes an extension 656 adapted to be retained at upper 646. Extension 656 includes a hole 660 adapted to be aligned with a shoe lace hole 662, such that extension 656 and therefore outsole portion 648*a* can be tied to upper 646 by a shoe lace. This particular retention structure is merely exemplary. When retention is desired, the foregoing structure can be replaced by essentially any mechanism capable of retaining the outsole in the closed position, such as snaps or hook-and-loop fasteners (e.g. Velcro®).

Figure 35:
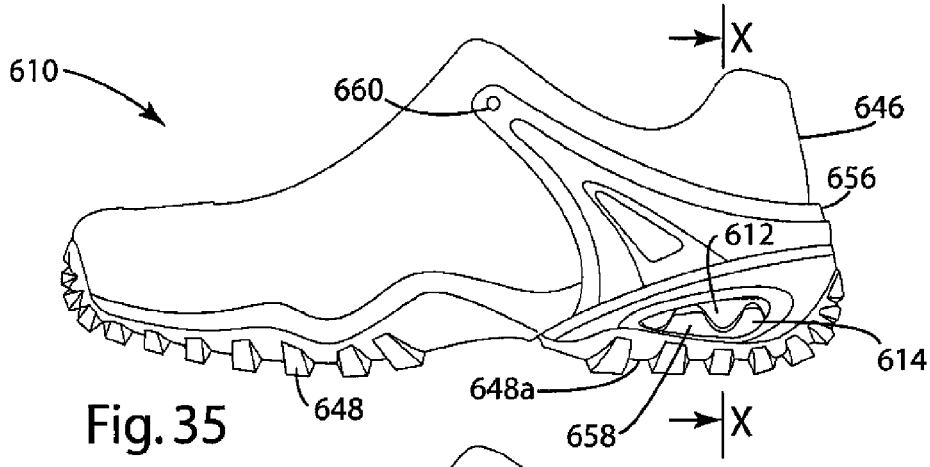
FIG. 35 is a side elevational view of a shoe construction of a fourth alternative embodiment.

Optionally, outsole portion 648*a* or extension 656 may include an opening 658 through which cushion insert 614 may be viewed when outsole portion 648*a* is in a non-pivoted position (See FIG. 35). In such an embodiment, indicators of the position and/or resulting support characteristics of insert 614 may be printed on an outer surface of insert 614 and may be viewable through opening 658. Thus, the user is aware of the position of cushion insert 614 without having to open or pivot outsole portion 648*a*.

Figure 40:
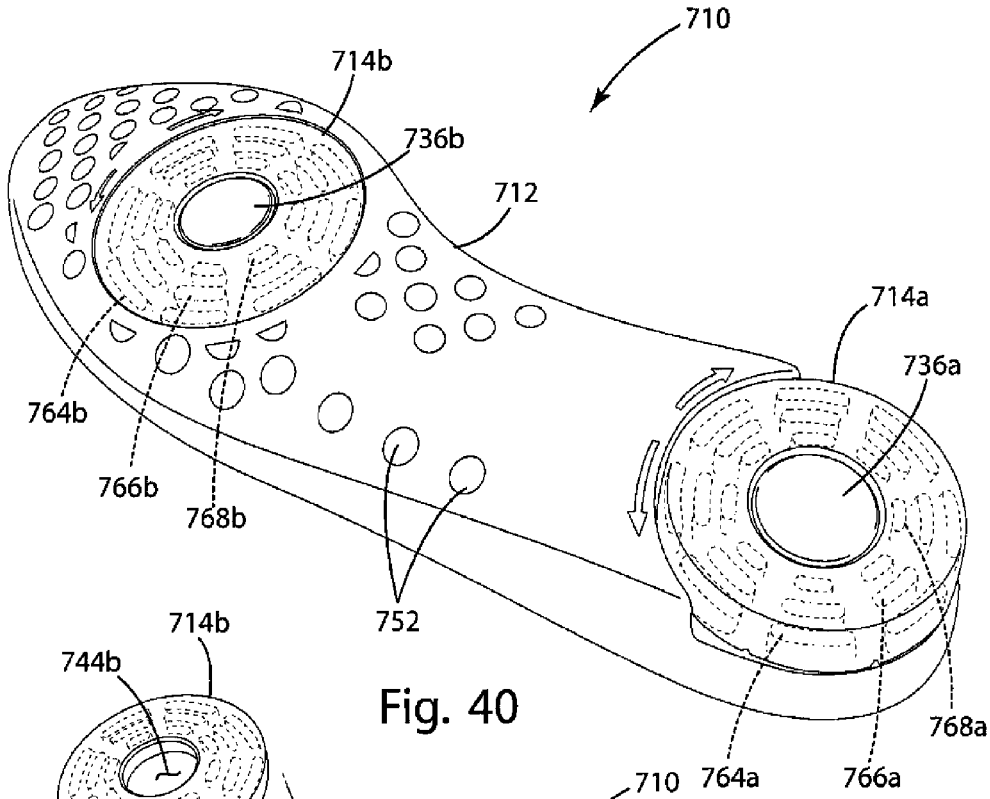
FIG. 40 is a bottom perspective view of a sole construction of a fifth alternative embodiment.

In a fifth alternative embodiment, a sole construction 710 includes a midsole 712 and at least one cushion insert, such as the cushion inserts 714*a* and 714*b* shown in FIG. 40. Cushion inserts 714*a* and 714*b* include at least one channel therein, the depth of which varies about the cushion insert. Cushion inserts 714*a* and 714*b* are configured to be removably fitted into respective receptacles in midsole 712 at different orientations to provide different support/cushioning characteristics. Given the generally planar mating surfaces in the illustrated embodiment, the cushion inserts 714*a* and 714*b* can be rotated to essentially any orientation without regard to alignment of lobes in the inserts and the mating surfaces.

Figure 41:
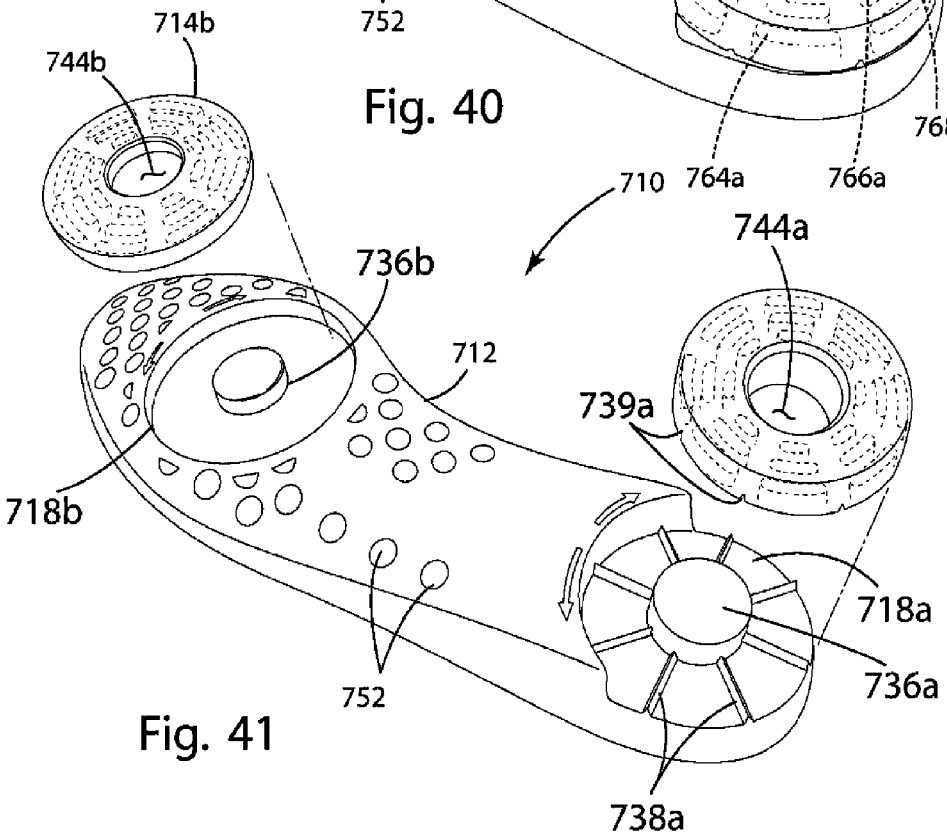
FIG. 41 is a bottom perspective view of the fifth alternative embodiment, shown with the cushion inserts removed.
Figure 42:
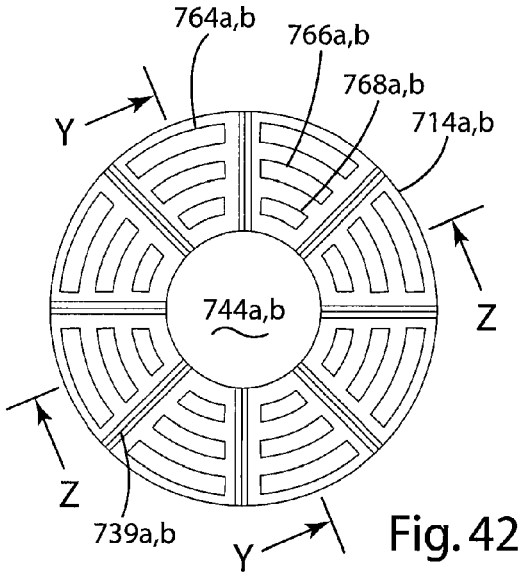
FIG. 42 is a top plan view of a cushion insert of the fifth alternative embodiment.

As shown in FIGS. 40 and 41, midsole 712 defines two receptacles 718*a* and 718*b* adapted to receive cushion insert 714*a* and 714*b*, respectively. Receptacle 718*a* is located in a heel region of midsole 712, while receptacle 718*b* is located in a forefoot region of midsole 712. However, cushion inserts may alternatively or additionally be positioned in other regions of the sole where the type of adjustability provided by this construction may be desirable. In the illustrated embodiment, receptacles 718*a* and 718*b* are defined as openings or voids in the bottom surface of midsole 712, such that midsole 712 may be similar to midsole 12 described above. However, receptacles 718*a* and 718*b* may also be formed in a top surface of midsole 712, similar to midsoles 212 and 412 above.

Figure 45:
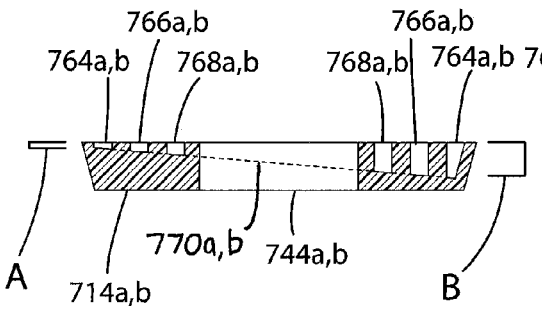
FIG. 45 is a sectional side elevational view of the cushion insert taken along lines Y-Y.
Figure 46:
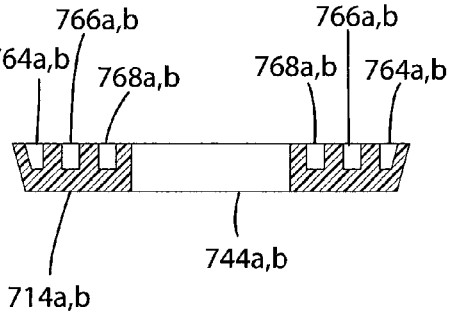
FIG. 46 is a sectional side elevational view of the cushion insert taken along lines Z-Z.
Figure 47:
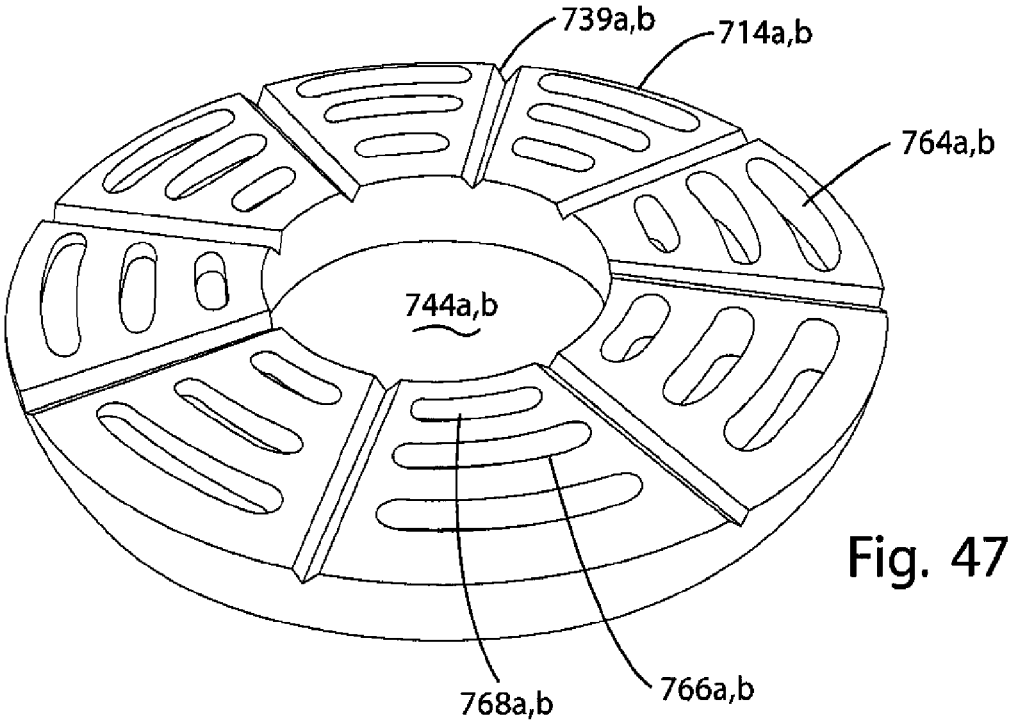
FIG. 47 is a perspective view of a cushion insert.
Figure 48:
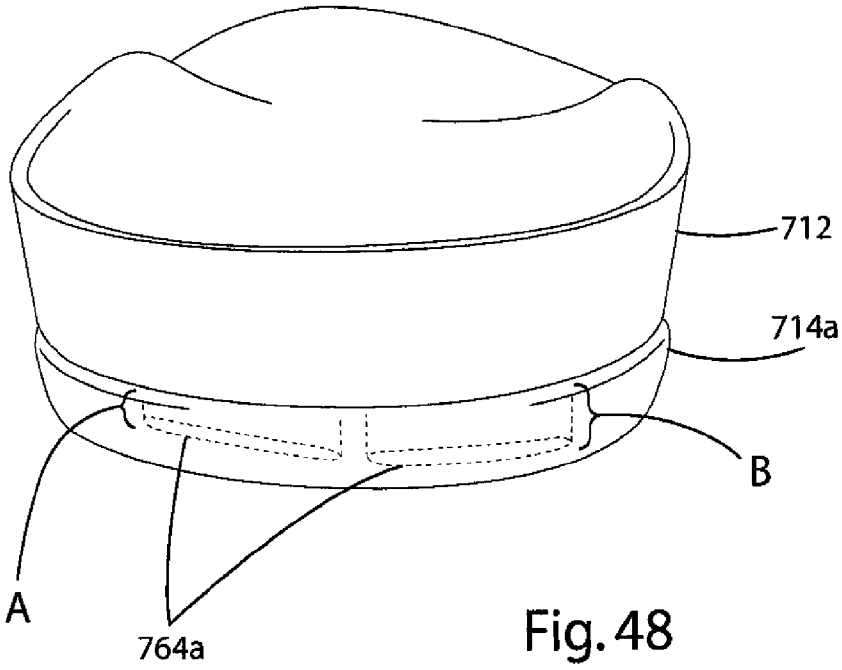
FIG. 48 is a rear elevational view of the fifth alternative embodiment.

In the illustrated embodiment, the top surface of each of the cushion inserts 714*a* and 714*b* generally defines three channels 764, 766 and 768, each of which vary in depth at different points along the insert (See FIGS. 42 and 45-47). The support characteristics of inserts 714*a* and 714*b* depend in large part on the depth of the channels, such that repositioning of the cushion inserts 714*a* and 714*b* and therefore the channels results in a change in the support/cushioning characteristics of the inserts. As shown in FIG. 45, channels 764, 766 and 768 of the illustrated embodiment are truncated by a single common plane or axis 770*a,b* extending through the channels at an orientation selected to provide a uniform taper from channels at a full depth B on one side of the insert 714*a,b* to channels at a substantially more shallow depth A at the opposite side of the insert. As shown in FIG. 46, a section of the insert 714*a,b* taken along a line perpendicular to the section shown in FIG. 45 shows the channels having a uniform depth across the width of the insert. In different applications, the truncating plane may be disposed at alternative orientations as appropriate to provide the desired cushioning characteristics. Further, channels 764, 766 and 768 need not be truncated by a single common plane (as shown in FIGS. 45 and 46), but may alternatively be truncated in angular sections or otherwise varied as desired to provide the desired cushioning/support characteristics throughout the range of adjustment of the cushion insert. Although the illustrated embodiment discloses truncated channels, adjustability may be provided by varying other characteristics of the cushion inserts 714*a* and 714*b* or the channels 764, 766 and 768, such as size, shape, configuration and materials, to provide the desired support/cushioning throughout the range of adjustability of the cushion inserts.

Optionally, to assist in aligning and/or retaining the inserts in the receptacles, inserts 714*a* and 714*b* may define central holes 744*a* and 744*b*, respectively, which are adapted to be fitted over central posts 736*a* and 736*b* (See FIGS. 40 and 41). The central holes and posts of this fifth alternative embodiment may be substantially similar or identical to the central holes and posts of the embodiments described in detail above. Additionally, or alternatively, the receptacles may include extensions or ribs corresponding to grooves in the cushion insert facilitate the alignment of cushion insert 714*a*. For example, receptacle 718*a* includes ribs 738*a* adapted to be fitted in grooves 739*a* in cushion insert 714*a* (See FIG. 41).

Figure 43:
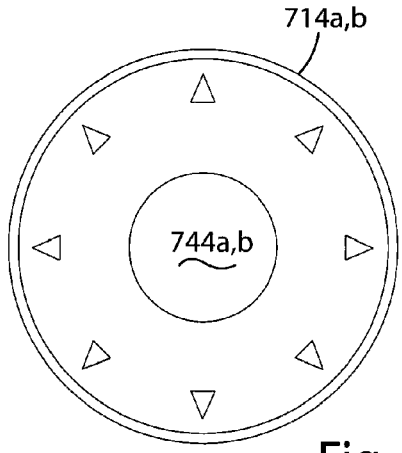
FIG. 43 is a bottom plan view of the cushion insert.
Figure 44:
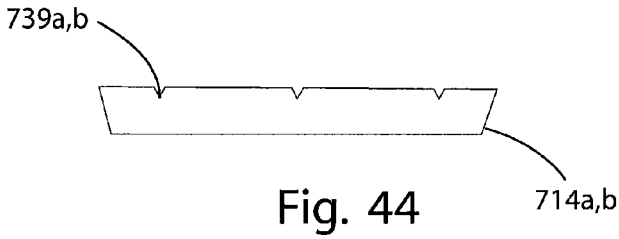
FIG. 44 is a side elevational view of the cushion insert.

To assist the user in achieving the correct orientation of cushion inserts 714*a* and 714*b*, a bottom surface of the inserts may include graphics, printed material or other alignment indicators. For example, as shown in FIG. 43, the insert 714*a,b* is provided with a plurality of arrows that illustrate permissible orientations of the insert. Optionally, the insert may include text or symbols that work in conjunction with the alignment indicators and to provide a visual indication of the results of the insert orientation. For example, the words "PRONATION," "SUPINATION," "REGULAR," and "FIRM" may be printed on the insert adjacent to the appropriate alignment indicators (not shown).

In a sixth alternative embodiment shown in FIGS. 49-56, a shoe construction 810 is shown having a midsole 812 and a cushion insert 814*a* or 814*b*. Shoe construction 810 includes an upper 846 and an outsole 848 adapted to receive and support midsole 812. Outsole 848 includes an opening 871 therein, through which a cushion insert 814*a* or 814*b* may be accessed and manipulated to vary the orientation of the insert to provide different support/cushioning characteristics.

Midsole 812 may be substantially similar to any of the midsoles 12, 212, 412, 512, 612 and 712 discussed in the above embodiments. In the illustrated embodiment, midsole 812 includes a receptacle in a bottom surface thereof for receiving cushion insert 814*a* or 814*b* (see FIG. 50).

Figure 49:
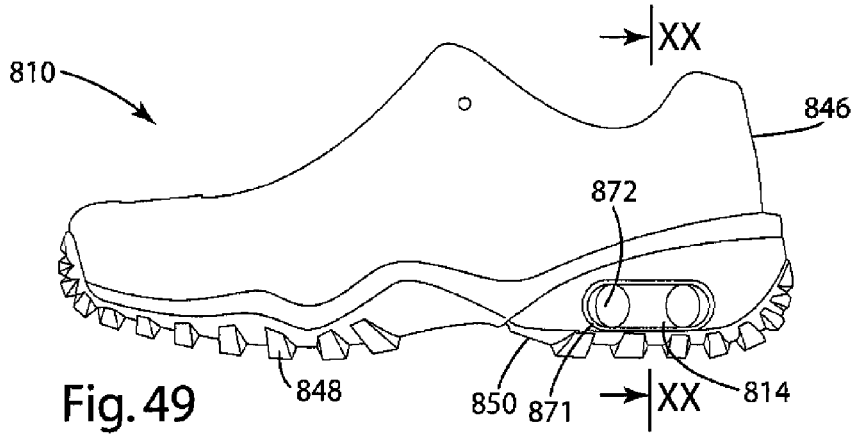
FIG. 49 is a side elevational view of a shoe having a sole construction of a sixth alternative embodiment.

The cushion insert of this embodiment is adapted to move with respect to midsole 812 while the insert is positioned in the receptacle of midsole 812. For example, the cushion insert may be formed with an upper surface that does not engage the bottom surface of the receptacle. In one of the illustrated embodiments, cushion insert 814*a* is substantially similar to cushion insert 714 described in detail above (See FIGS. 51 and 52). Specifically, insert 814*a* includes three channels 864, 866 and 868 therein, with the depth of the channels varying at different points about the insert. As shown in FIG. 49, channels 864, 866 and 868 are truncated by a common plane or axis 870*a* extending through the channels. As discussed above with respect to insert 714, the varying depths of the channels 864, 866 and 868 allow cushion insert 814*a* to be selectively positioned to provide the desired cushioning/support characteristics.

Figure 53:
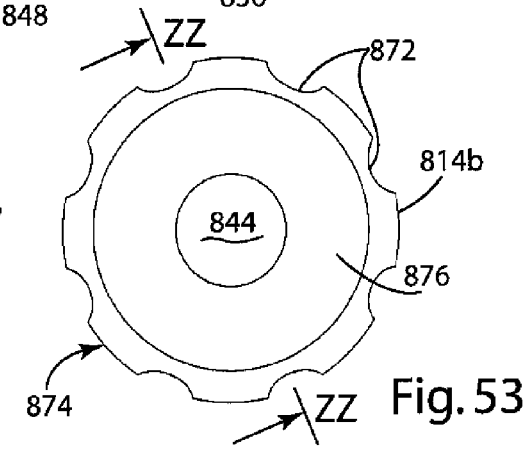
FIG. 53 is a top plan view of an alternative cushion insert in accordance with the sixth alternative embodiment.
Figure 52:
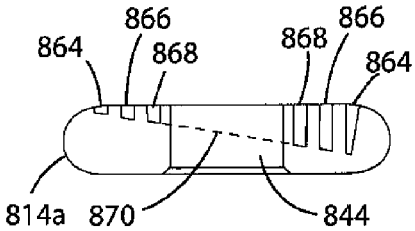
FIG. 52 is a sectional side elevational view of the cushion insert of FIG. 51 taken along lines YY-YY.
Figure 54:
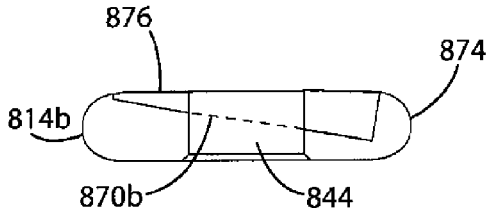
FIG. 54 is a sectional side elevational view of the alternative cushion insert of FIG. 53 taken along lines ZZ-ZZ.

As shown in FIGS. 53 and 54, an alternative cushion insert 814*b* is formed from at least two different materials each having different degrees of hardness and/or density or other material characteristic that provides varying levels of support. However, as an expedient, the layers containing these materials will be referred to herein as "harder layer" 874 and "softer layer" 876. In the illustrated embodiment, harder layer 874 forms an outer radial area and undersurface of insert 814*b*, which is disk-shaped. Softer layer 876 forms the remaining portion of insert 814*b*, with the depth of softer layer 874 varying about the insert. As shown in FIG. 54, the depth of softer layer 874 may be truncated by a common plane or axis 870*b* that divides the insert into regions of harder layer 874 and softer layer 876. In the illustrated embodiment, axis 870*b* is positioned at an orientation selected to provide a uniform taper from a shallow depth of softer layer 876 at one side of the insert to a greater depth at an opposite side of the insert. The varying depth of softer layer 876 allows cushion insert 814*b* to be selectively positioned to provide the desired cushioning/support characteristics. Although illustrated in connection with an insert 814*b* in which the harder layer 874 and softer layer 876 mate along a plane, the mating surfaces may be contoured to provide the desired cushioning characteristics. For example, the harder layer 874 and softer layer 876 may include mating lobes similar to those of midsole 12 and insert 14 described above. Any suitable manufacturing process may be used to achieve the two-material configuration of cushion insert 814*b*. For example, the different layers of cushion insert 814*b* may be separately manufactured and cemented together, integrally molded using multiple shots, or compression molded. Although secured in the illustrated embodiment, the two layers may remain separate, if desired. This may permit a user to separately replace the two layers. If desired, replacement layers may be provided with different cushioning characteristics and therefore provide a mechanism for further tuning the construction 810. Although the insert 814*b* is shown with two layers, the insert 814*b* may include more than two layers if desired.

Figure 55:
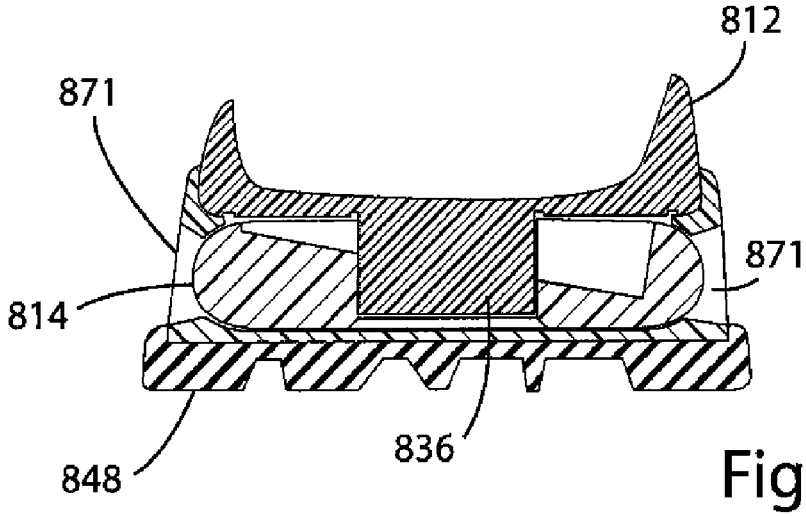
FIG. 55 is a sectional rear view of the sole construction and cushion insert taken along lines XX-XX.
Figure 56:
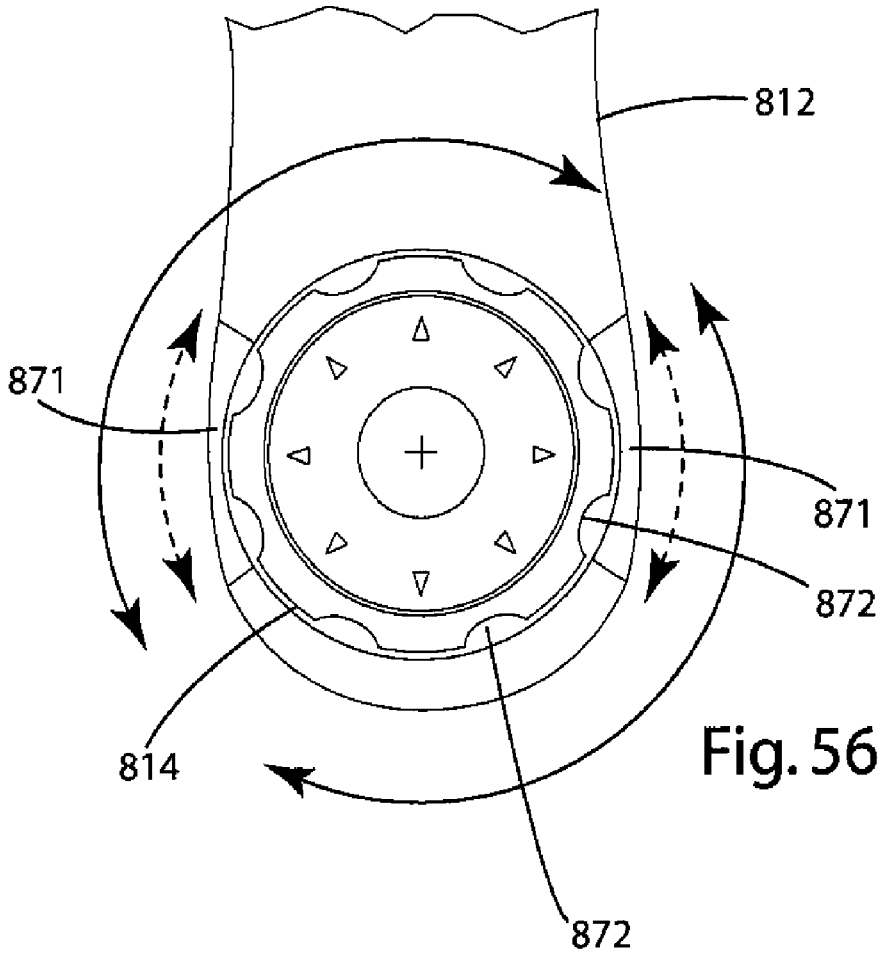
FIG. 56 is a sectional bottom plan view of the sole construction and cushion insert of the sixth alternative embodiment.

Thus, shoe construction 810 may include either insert 814*a* and 814*b*, each of which is adapted to be selectively rotated in the receptacle of midsole 812, without removal of the midsole 812 or outsole 848 from shoe construction 810. To facilitate the rotation of inserts 814*a* and 814*b* in the receptacle, at least one opening 871 in outsole 848 is positioned to provide access to an outer surface of insert 814*a* or 814*b*. As shown in FIGS. 55 and 56, outsole 848 includes an opening 871 on each side of shoe construction 810, such that insert 814*a* or 814*b* may be accessed and selectively rotated through either of the openings. In the illustrated embodiment, openings 871 are sized to allow a user to engage the insert with a finger.

Figure 51:
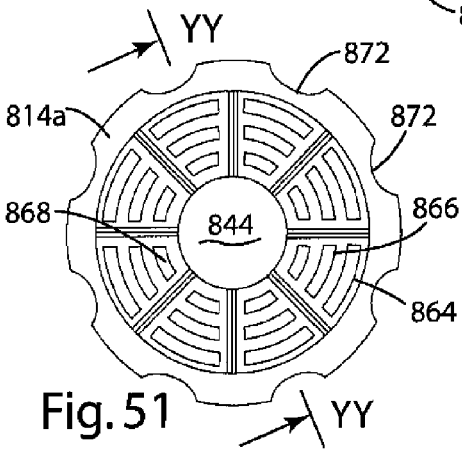
FIG. 51 is a top plan view of a cushion insert in accordance with the sixth alternative embodiment.

Optionally, to further assist in the rotation of insert 814*a* or 814*b*, inserts 814*a* and 814 may define notches, grooves or dimples 872 at an outer radial surface thereof (See FIGS. 51, 53 and 56). Dimples 872 are formed to accommodate a finger of the user, such that the insert 814*a* or 814*b* may be easily grasped and rotated. Dimples 872 may be uniformly spaced about the radial surface of insert 814*a* or 814*b* such that at least one dimple is accessible through openings 871 throughout the entire range of adjustability of insert 814*a* or 814*b*.

Figure 50:
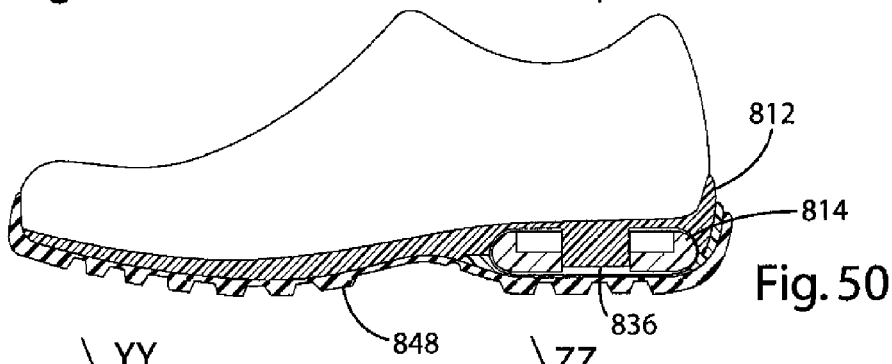
FIG. 50 is a sectional side elevational view of the sixth alternative embodiment.

To assist in maintaining the position of insert 814*a* or 814*b* in the receptacle of midsole 812, inserts 814*a* and 814*b* may optionally define central holes 844*a* and 844*b*, respectively, which are adapted to be fitted over central post 836 (See FIGS. 50 and 55). In such a configuration, inserts 814*a* and 814*b* are adapted to rotate about central post 836. Central holes 844*a* and 844*b* and post 836 may otherwise be substantially similar to the central holes and posts of the embodiments described above.

Although the illustrated embodiments provide a broad range of adjustability, an even greater range may be provided by providing interchangeable sets of cushion inserts. For example, an article of footwear may be sold with two pairs of cushioning inserts, each pair having different cushioning (e.g. hardness) characteristics. For example, one set of inserts can have a durometer ranging between approximately 35-40 on the Asker C scale, while a second set of inserts can have a durometer ranging between approximately 30-40 on the Asker A scale. Other inserts can also be manufactured with different hardnesses without departing from the spirit of the present invention. The characteristics of the different pairs may be varied in essentially any way, such as by varying the thickness, shape or material of the different pairs. FIG. 11*b* is an illustration of a cushion insert 14' having greater thickness than cushion insert 14. In use, cushion insert 14' may be installed in place of cushion insert 14 to provide additional cushioning.

The above description is that of the current embodiment of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

The embodiments of the invention in which an exclusive property or privilege is claimed are defined as follows:

1. A shoe comprising:

an upper;

a sole secured to said upper, said sole including a sole component and a cushion insert interfitted with said sole component, said sole component having an interface surface, said cushion insert having an interface surface interfacing with said sole component interface surface, said cushion insert interface surface and said sole component interface surface each having a general extent that is substantially parallel to a general extent of a bottom surface of said sole, said cushion insert interface surface having variations in shape toward and away from the general extent of the cushion insert interface surface, said cushion insert being rotatable in a plane about an axis extending generally perpendicular to the general extent of the bottom surface of the sole between at least first and second orientations, said variations in shape providing said sole with said first cushioning characteristics when in said first orientation, said variations in shape providing said sole with said second cushioning characteristics different from said first cushioning characteristics when in said second orientation, whereby said sole is readily adjustable between said first cushioning characteristics and said second cushioning characteristics by rotational movement of said insert with respect to said sole component.

2. The shoe of claim 1 wherein said sole component includes a receptacle receiving at least a portion of said cushion insert.

3. The shoe of claim 1 wherein said receptacle includes an axis, said receptacle axis substantially perpendicular to the general extent of the bottom surface of said sole, whereby rotation of said insert about said receptacle axis results in variation of a cushioning characteristic of said sole.

4. The shoe of claim 3, wherein said cushion insert includes at least one of varying projections extending from said cushion insert and channels formed in said cushion insert.

5. The shoe of claim 1 wherein said sole component interface surface has projections extending therefrom for engaging said cushion insert interface surface.

6. The shoe of claim 1, wherein said cushion insert is accessible from a top surface of said sole component.

7. The shoe of claim 6, wherein said cushion insert is manually removable from a top surface of said sole component.

8. The shoe of claim 1, wherein said variations in shape include at least one of undulations, ridges and lobes.

9. A sole for footwear comprising:

a sole component including at least one receptacle; and an adjustable cushion insert fitted within said receptacle, said cushion insert capable of being rotated about an axis between at least two different orientations that provide the sole with different cushioning characteristics, said axis substantially perpendicular to a general extent of a bottom surface of the sole;

wherein said cushion insert has an interface surface, a general extent of said cushion insert interface surface being substantially planar and substantially perpendicular to said axis, said cushion insert interface surface having shape variations with respect to the general extent of the cushion insert interface surface;

wherein said receptacle has an interface surface, said receptacle interface surface having a general extent, the general extent of said receptacle interface surface being substantially planar, said receptacle interface surface engaging said cushion insert interface surface, said receptacle interface surface having shape variations with respect to the general extent of said receptacle interface surface, said cushion insert interface surface shape variations and said receptacle interface surface shape variations preventing said cushion insert from being rotated when said cushion insert is seated in said receptacle.

10. The sole of claim 9 wherein said cushion insert interface surface shape variations and said receptacle interface surface shape variations include at least one of undulations, ridges and lobes.

11. The sole of claim 10 wherein said receptacle interface surface is a top surface of said receptacle and said cushion insert interface surface is a bottom surface of said cushion insert.

12. The sole of claim 9 wherein said cushion insert is manually accessible from a top surface of said sole component.

13. The sole of claim 12 wherein a sock liner is positioned adjacent said sole component, said sock liner including a transparent or translucent material to allow viewing of said cushion insert through said sock liner.

14. The sole of claim 9 wherein said receptacle opens upwardly toward a top surface of said sole component.

15. A shoe comprising:

an upper;

a sole secured to said upper, said sole including a sole component and a cushion insert interfitted with said sole component, said sole component having an interface surface, said cushion insert having an interface surface interfacing with said sole component interface surface, said cushion insert interface surface having a general extent that is substantially horizontal, said cushion insert interface surface having variations in shape in a substantially vertical direction toward and away from the general extent, said cushion insert being rotatable with respect to said sole component in a substantially horizontal plane about a substantially vertical axis between at least first and second orientations, said variations in shape providing said sole with said first cushioning characteristics when in said first orientation, said variations in shape providing said sole with said second cushioning characteristics different from said first cushioning characteristics when in said second orientation, wherein said variations in shape prevent adjustment of said cushion insert with respect to said sole component when said cushion insert is seated in said sole component.

16. The shoe of claim 15 wherein said sole component interface surface has variations in shape, said variations in shape of said sole component interface surface interfacing with said variations in shape of said cushion insert interface surface to prevent adjustment of said cushion insert with respect to said sole component.

17. The shoe of claim 16 wherein a general extent of said sole component interface surface and the general extent of said cushion insert interface surface are substantially planar and are substantially perpendicular to the cushion insert axis.

18. The shoe of claim 15 wherein said cushion insert interface surface and said sole component interface surface each include at least one lobe.

19. The shoe of claim 18 wherein said cushion insert interface surface and said sole component interface surface each include a plurality of lobes such that each of said lobes on said cushion insert interface surface fit between at least two of said lobes on said sole component interface surface.

20. The shoe of claim 19 wherein said cushion insert may be rotated about an axis, wherein said cushion insert lobes are arranged in a repeating pattern about said axis.

21. The shoe of claim 20 wherein said sole component lobes are arranged in a repeating pattern about said axis.

22. The shoe of claim 15 wherein said sole component defines a receptacle, said receptacle opening upwardly to allow access to said cushion insert from a top surface of said sole component.

* * * * *